US011993888B2

(12) United States Patent
Huang et al.

(10) Patent No.: US 11,993,888 B2
(45) Date of Patent: May 28, 2024

(54) LAUNDRY TREATMENT AGENT DISPENSING ASSEMBLY FOR USE IN LAUNDRY TREATMENT DEVICE, AND LAUNDRY TREATMENT DEVICE

(71) Applicants: QINGDAO HAIER WASHING MACHINE CO., LTD., Shandong (CN); Haier Smart Home Co., Ltd., Shandong (CN)

(72) Inventors: Tao Huang, Qingdao (CN); Bencai Huang, Qingdao (CN)

(73) Assignees: QINGDAO HAIER WASHING MACHINE CO., LTD., Shandong (CN); Haier Smart Home Co., Ltd., Shandong (CN)

( * ) Notice: Subject to any disclaimer, the term of this patent is extended or adjusted under 35 U.S.C. 154(b) by 124 days.

(21) Appl. No.: 17/623,018

(22) PCT Filed: Jun. 12, 2020

(86) PCT No.: PCT/CN2020/095739
§ 371 (c)(1),
(2) Date: Dec. 27, 2021

(87) PCT Pub. No.: WO2020/259315
PCT Pub. Date: Dec. 30, 2020

(65) Prior Publication Data

US 2022/0267941 A1 Aug. 25, 2022

(30) Foreign Application Priority Data

Jun. 25, 2019 (CN) ..... 201910555542.8
Jun. 25, 2019 (CN) ..... 201910555548.5
(Continued)

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

U.S. PATENT DOCUMENTS

2018/0363214 A1 12/2018 Doyle et al.

FOREIGN PATENT DOCUMENTS

CN 205741633 U 11/2016
CN 107354679 A 11/2017
(Continued)

OTHER PUBLICATIONS

International Search Report dated Sep. 16, 2020 in corresponding International application No. PCT/CN2020/095739; 8 pages.

*Primary Examiner* — Jason Y Ko
(74) *Attorney, Agent, or Firm* — Maier & Maier, PLLC

(57) ABSTRACT

A laundry treatment agent dispensing assembly for use in a laundry treatment device, and a laundry treatment device including a body; the laundry treatment agent dispensing assembly includes a storage container fixed to the body, a dispensing container slidably connected to the body, and a liquid guiding cannula; one end of the liquid guiding cannula is communicated with the dispensing container, and the other end of the liquid guiding cannula is inserted into the storage container; the length of the liquid guiding cannula is set so that the other end of the liquid guiding cannula does not go out of the storage container when the dispensing container moves away from the storage container; when a laundry treatment agent is added, it is only needed to pull the dispensing container from the body, and the liquid guiding cannula enables the dispensing container to be communicated with the storage container.

14 Claims, 20 Drawing Sheets

(30) Foreign Application Priority Data

Jun. 25, 2019 (CN) ..... 201910555561.0
Jun. 25, 2019 (CN) ..... 201910556645.6

(56) References Cited

FOREIGN PATENT DOCUMENTS

| | | | |
|---|---|---|---|
| CN | 207760580 | U | 8/2018 |
| CN | 208266491 | U | 12/2018 |
| CN | 208414881 | U | 1/2019 |
| CN | 208701370 | U | 4/2019 |

LAUNDRY TREATMENT AGENT DISPENSING ASSEMBLY FOR USE IN LAUNDRY TREATMENT DEVICE, AND LAUNDRY TREATMENT DEVICE

FIELD

The present disclosure belongs to the technical field of clothing treatment, and specifically provides a clothing treatment agent dispensing assembly for a clothing treatment device, and a clothing treatment device.

BACKGROUND

A clothing treatment device is a machine capable of washing, spin-drying, dry-washing and/or drying clothing. Common clothing treatment devices include a washing machine, a shoe washing machine, a clothing dryer, a dry-washing machine, and a washing-drying integrated machine.

With the continuous improvement of the technical level of production and the increasing demand of users, the functionality of existing clothing treatment devices is gradually enhanced. Taking a washing machine as an example, the washing machine includes a body and a detergent dispensing assembly arranged in the body, and the detergent dispensing assembly can inject a detergent into a working cavity of the washing machine. Since a detergent box in the detergent dispensing assembly has a large volume, the user needs to pull and push the detergent box with a greater force when adding the detergent, which makes it inconvenient for the user to operate, and reduces the user's experience in use.

Accordingly, there is a need in the art for a new clothing treatment agent dispensing assembly for a clothing treatment device and a corresponding clothing treatment device to solve the above-mentioned problem.

SUMMARY

First Technical Solution

In order to solve the above problem in the prior art, that is, to solve the problem of inconvenient dispensing of the clothing treatment agent of the existing clothing treatment devices, which results in poor user's experience, the present disclosure provides a clothing treatment agent dispensing assembly for a clothing treatment device, in which the clothing treatment device includes a body, and the clothing treatment agent dispensing assembly includes a storage container, a dispensing container, and a liquid guiding tube; the storage container is fixed in the body, and the dispensing container is slidably connected to the body; one end of the liquid guiding tube is in communication with the dispensing container, and the other end of the liquid guiding tube is inserted into the storage container; and a length of the liquid guiding tube is set such that the other end of the liquid guiding tube will not come out of the storage container when the dispensing container moves away from the storage container.

In a preferred technical solution of the above clothing treatment agent dispensing assembly, a guiding structure is provided on the storage container, and the other end of the liquid guiding tube passes through the guiding structure and is inserted into the storage container.

In a preferred technical solution of the above clothing treatment agent dispensing assembly, the clothing treatment agent dispensing assembly further includes a sealing member, which includes a body part, as well as a first sealing part and a second sealing part that are formed on the body part, the first sealing part sealedly abutting against an outer wall of the liquid guiding tube, and the sealing member being sealedly connected to the guiding structure through the second sealing part.

In a preferred technical solution of the above clothing treatment agent dispensing assembly, the sealing member is a sealing ring, and an inner diameter of the body part of the sealing ring is larger than an outer diameter of the liquid guiding tube.

In a preferred technical solution of the above clothing treatment agent dispensing assembly, the first sealing part is a sealing lip formed on an inner wall of the body part of the sealing ring.

In a preferred technical solution of the above clothing treatment agent dispensing assembly, the sealing lip is arranged inclinedly in a direction from the dispensing container to the storage container.

In a preferred technical solution of the above clothing treatment agent dispensing assembly, the sealing ring is sealedly connected to an outer wall of the guiding structure through the second sealing part.

In a preferred technical solution of the above clothing treatment agent dispensing assembly, the second sealing part includes at least one ring-shaped sealing rib or sealing groove formed on an inner wall of the body part of the sealing ring, and the outer wall of the guiding structure is correspondingly provided with at least one ring-shaped sealing groove or sealing rib, in which the ring-shaped sealing rib corresponds to the ring-shaped sealing groove in a one-to-one correspondence, and there is a transitional fit or an interference fit between the ring-shaped sealing rib and the ring-shaped sealing groove so that the sealing ring and the guiding structure are sealedly connected.

In a preferred technical solution of the above clothing treatment agent dispensing assembly, the second sealing part includes a first ring-shaped sealing rib and a second ring-shaped sealing rib that are formed on the inner wall of the body part of the sealing ring, and the outer wall of the guiding structure is correspondingly provided with a first ring-shaped sealing groove and a second ring-shaped sealing groove, in which there is a transitional fit or an interference fit between the first ring-shaped sealing rib and the first ring-shaped sealing groove, and there is a transitional fit or an interference fit between the second ring-shaped sealing rib and the second ring-shaped sealing groove.

In a preferred technical solution of the above clothing treatment agent dispensing assembly, the second sealing part includes at least one ring-shaped sealing rib or sealing groove formed on an outer wall of the body part of the sealing ring, and an inner wall of the guiding structure is correspondingly provided with at least one ring-shaped sealing groove or sealing rib, in which the ring-shaped sealing rib corresponds to the ring-shaped sealing groove in a one-to-one correspondence, and there is a transitional fit or an interference fit between the ring-shaped sealing rib and the ring-shaped sealing groove so that the sealing ring and the guiding structure are sealedly connected.

In a preferred technical solution of the above clothing treatment agent dispensing assembly, the guiding structure is a guide tube joint formed on an outer wall of the storage container.

In a preferred technical solution of the above clothing treatment agent dispensing assembly, the clothing treatment agent dispensing assembly further includes a push switch, and the push switch is arranged to be capable of locking the dispensing container on the body and/or the storage container after the dispensing container is pushed into the body.

In a preferred technical solution of the above clothing treatment agent dispensing assembly, the clothing treatment agent dispensing assembly further includes a telescopic tube, one end of the liquid guiding tube is in communication with the dispensing container through the telescopic tube, and the telescopic tube can be extended and retracted to allow the dispensing container to move toward the storage container when the liquid guiding tube is stuck or does not move smoothly enough, so as to unlock the push switch and thus enable the push switch to push the dispensing container out.

In a preferred technical solution of the above clothing treatment agent dispensing assembly, the clothing treatment agent dispensing assembly further includes a sealed connection structure, and the sealed connection structure is arranged between the telescopic tube and the dispensing container and/or between the telescopic tube and the liquid guiding tube.

In a preferred technical solution of the above clothing treatment agent dispensing assembly, the sealed connection structure includes a first sealed connection structure, and one end of the telescopic tube is sealedly connected with the dispensing container through the first sealed connection structure.

In a preferred technical solution of the above clothing treatment agent dispensing assembly, the first sealed connection structure includes a first sealed connection part formed on the dispensing container and a second sealed connection part formed on the telescopic tube, one end of the telescopic tube being sealedly connected to the dispensing container through the first sealed connection part and the second sealed connection part.

In a preferred technical solution of the above clothing treatment agent dispensing assembly, the first sealed connection part is a ring-shaped sealing rib or a ring-shaped sealing groove, and correspondingly the second sealed connection part is a ring-shaped sealing groove or a ring-shaped sealing rib, one end of the telescopic tube being sealedly connected to the dispensing container through the ring-shaped sealing rib and the ring-shaped sealing groove.

In a preferred technical solution of the above clothing treatment agent dispensing assembly, the first sealed connection part is a ring-shaped sealing rib formed on an inner wall of the dispensing container, and the second sealed connection part is a ring-shaped sealing groove formed on an outer wall of the telescopic tube.

In a preferred technical solution of the above clothing treatment agent dispensing assembly, the clothing treatment agent dispensing assembly further includes a fixing ring, which is arranged at a connection position between the telescopic tube and the dispensing container, and in an assembled state, an outer wall of the fixing ring abuts against an inner wall of the telescopic tube to prevent the ring-shaped sealing groove and the ring-shaped sealing rib from being separated from each other.

In a preferred technical solution of the above clothing treatment agent dispensing assembly, the fixing ring includes a ring-shaped body and a positioning structure connected to the ring-shaped body, and the positioning structure is arranged to be capable of preventing the fixing ring from moving in the direction of the telescopic tube.

In a preferred technical solution of the above clothing treatment agent dispensing assembly, the positioning structure is a positioning flange which is perpendicularly connected to the ring-shaped body of the fixing ring, and in an assembled state, the positioning flange abuts against an end of the telescopic tube.

In a preferred technical solution of the above clothing treatment agent dispensing assembly, the sealed connection structure further includes a second sealed connection structure, and the other end of the telescopic tube is sealedly connected to one end of the liquid guiding tube through the second sealed connection structure.

In a preferred technical solution of the above clothing treatment agent dispensing assembly, the second sealed connection structure includes a third sealed connection part formed on the telescopic tube and a fourth sealed connection part formed on the liquid guiding tube, and the other end of the telescopic tube is sealedly connected to one end of the liquid guiding tube through the third sealed connection part and the fourth sealed connection part.

In a preferred technical solution of the above clothing treatment agent dispensing assembly, the third sealed connection part is a ring-shaped sealing rib or a ring-shaped sealing groove, and correspondingly the fourth sealed connection part is a ring-shaped sealing groove or a ring-shaped sealing rib, the other end of the telescopic tube being sealedly connected to one end of the liquid guiding tube through the ring-shaped sealing rib and the ring-shaped sealing groove.

In a preferred technical solution of the above clothing treatment agent dispensing assembly, a support structure is provided on the dispensing container, and in an assembled state, the telescopic tube is located above the support structure.

In a preferred technical solution of the above clothing treatment agent dispensing assembly, the support structure is a U-shaped plate, and in an assembled state, the telescopic tube is located in a receiving cavity formed by the U-shaped plate.

In a preferred technical solution of the above clothing treatment agent dispensing assembly, the telescopic tube is a bellows or a telescopic sleeve.

In a preferred technical solution of the above clothing treatment agent dispensing assembly, the clothing treatment agent dispensing assembly further includes an anti-disengaging member, one end of the anti-disengaging member is fixedly connected to the dispensing container, and a connection structure between the other end of the anti-disengaging member and the liquid guiding tube is arranged such that when the dispensing container moves away from the storage container, the dispensing container drives the liquid guiding tube to move with the aid of the anti-disengaging member, and that when the dispensing container moves close to the storage container, the anti-disengaging member slides along an outer wall of the liquid guiding tube.

In a preferred technical solution of the above clothing treatment agent dispensing assembly, the connection structure includes a limiting structure provided on the outer wall of the liquid guiding tube and an anti-disengaging structure provided on the other end of the anti-disengaging member; when the dispensing container moves away from the storage container together with the anti-disengaging member, the liquid guiding tube can be driven to move through the cooperation of the limiting structure and the anti-disengaging structure.

In a preferred technical solution of the above clothing treatment agent dispensing assembly, the limiting structure is a ring-shaped limiting rib or a ring-shaped boss formed on the outer wall of the liquid guiding tube, and correspondingly the anti-disengaging structure is a ring-shaped boss or a ring-shaped limiting rib; and in an assembled state, when the dispensing container moves away from the storage container together with the anti-disengaging member, the ring-shaped limiting rib abuts against the ring-shaped boss.

In a preferred technical solution of the above clothing treatment agent dispensing assembly, the dispensing container is provided with a first snap-fit structure, the anti-disengaging member is provided with a second snap-fit structure, and the dispensing container is fixedly connected to one end of the anti-disengaging member through the first snap-fit structure and the second snap-fit structure.

In a preferred technical solution of the above clothing treatment agent dispensing assembly, one of the first snap-fit structure and the second snap-fit structure is a snap-fit protrusion, the other of the first snap-fit structure and the second snap-fit structure is a snap-fit opening, and the snap-fit protrusion matches with the snap-fit opening.

In a preferred technical solution of the above clothing treatment agent dispensing assembly, a sliding part is provided on the dispensing container, a roller that cooperates with the sliding part is provided on the body, and the dispensing container is slidably connected with the body through the sliding part and the roller.

In another aspect, the present disclosure also provides a clothing treatment device, which includes the clothing treatment agent dispensing assembly described above.

It can be understood by those skilled in the art that in the preferred technical solutions of the present disclosure, the clothing treatment agent dispensing assembly is configured as a split structure, that is, the storage container and the dispensing container are separately provided, and only the dispensing container is slidably connected with the body, so that when the user is putting in the clothing treatment agent, he/she only needs to pull out the dispensing container without also pulling out the storage container, which is labor-saving and fast and improves the user's experience in use; moreover, there is a liquid guiding tube between the dispensing container and the storage container, and the other end of the liquid guiding tube is inserted into the storage container; when the dispensing container is being pulled, the liquid guiding tube moves with the dispensing container, but the other end of the liquid guiding tube will not come out of the storage container, so that the liquid guiding tube always makes the dispensing container communicate with the storage container; therefore, when the clothing treatment agent is injected into the dispensing container, the clothing treatment agent can be delivered to the storage container through the liquid guiding tube.

Further, the liquid guiding tube is inserted into the storage container through a guiding structure provided on the storage container. The guiding structure guides the liquid guiding tube, which can prevent the liquid guiding tube from deviating during the movement, thereby improving the reliability of the clothing treatment agent dispensing assembly.

Still further, a sealing member is also provided between the liquid guiding tube and the guiding structure, and the sealing member can prevent leakage of the clothing treatment agent and improve the user's experience.

Still further, an inner diameter of the body part of the sealing ring is larger than an outer diameter of the liquid guiding tube. Through such an arrangement, installation of the liquid guiding tube is facilitated, and an assembly efficiency of the clothing treatment agent dispensing assembly can be improved.

Still further, the first sealing part is a sealing lip formed on the inner wall of the body part of the sealing ring. By making the sealing lip sealedly abut against the outer wall of the liquid guiding tube, the clothing treatment agent in the storage container can be prevented from leaking along the outer wall of the liquid guiding tube, and when the liquid guiding tube is being pulled out, the sealing lip can scrape off the clothing treatment agent adhered to the outer wall of the liquid guiding tube to prevent the clothing treatment agent from leaking.

Still further, the sealing lip is arranged inclinedly in the direction from the dispensing container to the storage container. Such an arrangement facilitates the liquid guiding tube to pass through the sealing ring smoothly, thereby further improving the assembly efficiency of the clothing treatment agent assembly; moreover, the inwardly inclined sealing lip abuts more closely to the outer wall of the liquid guiding tube, and when the liquid guiding tube is being pulled out, such an arrangement is more advantageous for the sealing lip to scrape off the clothing treatment agent adhered to the outer wall of the liquid guiding tube, thereby further improving the sealing effect of the sealing ring.

Still further, the sealing ring is sealedly connected to the outer wall of the guiding structure through the second sealing part. Such an arrangement can prevent an excessive friction exerted on the outer wall of the liquid guiding tube from affecting the movement of the liquid guiding tube, and can improve the sealing performance of the sealing ring. Specifically, if the sealing ring is arranged between the inner wall of the guiding structure and the outer wall of the liquid guiding tube, the outer wall of the liquid guiding tube will be subjected to a greater friction which will affect the movement of the liquid guiding tube. Therefore, sealedly connecting the sealing ring with the outer wall of the guiding structure can prevent the outer wall of the liquid guiding tube from being subjected to a greater friction. In addition, the clothing treatment agent in the storage container flows to the sealing ring along a gap between the liquid guiding tube and the guiding structure, and a reverse flow is required for the clothing treatment agent before it is able to leak from a possible slit between the sealing ring and the outer wall of the guiding structure, so that the sealing performance of the sealing ring is improved.

Still further, there is a transitional fit or an interference fit between the ring-shaped sealing rib and the ring-shaped sealing groove. Through such an arrangement, the connection stability and sealing performance of the sealing ring and the guiding structure can be improved.

Still further, the second sealing part includes a first ring-shaped sealing rib and a second ring-shaped sealing rib that are formed on the inner wall of the body part of the sealing ring, and the outer wall of the guiding structure is correspondingly provided with a first ring-shaped sealing groove and a second ring-shaped sealing groove, in which there is a transitional fit or an interference fit between the first ring-shaped sealing rib and the first ring-shaped sealing groove, and there is a transitional fit or an interference fit between the second ring-shaped sealing rib and the second ring-shaped sealing groove. By arranging two sets of ring-shaped sealing ribs and ring-shaped sealing grooves, an effect of double guarantee can be achieved, that is, after one set of ring-shaped sealing rib and ring-shaped sealing groove fails, the other set of ring-shaped sealing rib and ring-shaped sealing groove can also be used to connect the sealing ring and the guiding structure in a sealed manner, so that the connection stability and sealing performance between the sealing ring and the guiding structure can be further improved.

Still further, the clothing treatment agent dispensing assembly further includes a push switch, and the push switch is arranged to be capable of locking the dispensing container on the body and/or the storage container after the dispensing container is pushed into the body. By using the push switch to lock the dispensing container on the body and/or the storage container, the dispensing container can be prevented from automatically sliding off the body, thereby improving the safety of the clothing treatment agent dispensing assembly; moreover, when the user needs to add the clothing treatment agent or when it is necessary to clean the dispensing container, it is only required to gently push the dispensing container to unlock the push switch. After the push switch is unlocked, the dispensing container can be automatically pushed out, thereby improving the user's experience in use.

Still further, the clothing treatment agent dispensing assembly further includes a telescopic tube, and one end of the liquid guiding tube is in communication with the dispensing container through the telescopic tube. By communicating the liquid guiding tube with the dispensing container through the telescopic tube, a situation in which the push switch cannot be unlocked is avoided. Specifically, if the liquid guiding tube is in direct communication with the dispensing container, when the liquid guiding tube is adhered on the inner wall of the storage container by the clothing treatment agent and cannot move, or when the liquid guiding tube is stuck and cannot move, the dispensing container also cannot move, so that no pressure can be applied to the push switch, and therefore the push switch cannot be unlocked. However, in the present disclosure, a telescopic tube is arranged between the liquid guiding tube and the dispensing container. When the above situation occurs in which the liquid guiding tube cannot move or the movement is not smooth enough, the telescopic tube can be compressed, so that the dispensing container can move toward the storage container to unlock the push switch; moreover, due to the viscous effect of the clothing treatment agent, the movement of the liquid guiding tube may be affected. By providing the telescopic tube, the push switch can be unlocked more quickly to improve the user's experience in use.

Still further, one end of the telescopic tube is sealedly connected to the dispensing container through a first sealed connection structure. By connecting the telescopic tube with the dispensing container through the first sealed connection structure, on the basis of connecting the telescopic tube with the dispensing container, the clothing treatment agent can also be prevented from leaking from the connection position between the telescopic tube and the dispensing container.

Still further, a fixing ring is arranged at the connection position between the telescopic tube and the dispensing container, and in an assembled state, the outer wall of the fixing ring abuts against the inner wall of the telescopic tube to prevent the ring-shaped sealing groove and the ring-shaped sealing rib from being separated from each other. The fixing ring provides support and reinforcement, which improves the connection stability and sealing performance between the telescopic tube and the dispensing container.

Still further, a positioning structure is provided on the fixing ring, and the positioning structure can prevent the fixing ring from moving in the direction of the telescopic tube, so that the fixing ring can be positioned at a set position, which improves the reliability of the fixing ring, and further improves the connection stability and sealing performance between the telescopic tube and the dispensing container.

Still further, the other end of the telescopic tube is sealedly connected to one end of the liquid guiding tube through a second sealed connection structure. By sealedly connecting the telescopic tube with the liquid guiding tube through the second sealed connection structure, on the basis of connecting the telescopic tube with the liquid guiding tube, the clothing treatment agent can also be prevented from leaking from the connection position between the telescopic tube and the liquid guiding tube.

Still further, a support structure is provided on the dispensing container, and in an assembled state, the telescopic tube is located above the support structure. By supporting the telescopic tube by the support structure, the telescopic tube can be prevented from being deformed under the action of gravity of the clothing treatment agent, which would otherwise affect the movement of the dispensing container, thereby improving the reliability of the clothing treatment agent dispensing assembly.

Still further, the clothing treatment agent dispensing assembly further includes an anti-disengaging member, one end of the anti-disengaging member is fixedly connected to the dispensing container, and a connection structure between the other end of the anti-disengaging member and the liquid guiding tube is arranged such that when the dispensing container moves away from the storage container, the dispensing container drives the liquid guiding tube to move with the aid of the anti-disengaging member, and that when the dispensing container moves close to the storage container, the anti-disengaging member slides along the outer wall of the liquid guiding tube. Through such an arrangement, the liquid guiding tube and the dispensing container can be prevented from being separated from each other, thereby preventing the liquid guiding tube from completely entering the storage container, and improving the reliability of the clothing treatment agent dispensing assembly; moreover, when the dispensing container is being pulled, a pulling force can be applied to the outer wall of the liquid guiding tube through the anti-disengaging member to drive the liquid guiding tube to move, which can avoid affecting the sealing performance at the connection position between the dispensing container and the liquid guiding tube, and can further prevent the leakage of the clothing treatment agent. In addition, the arrangement can also avoid affecting the unlocking of the push switch. Specifically, if the liquid guiding tube cannot move or does not move smoothly enough, when the dispensing container is pushed, the anti-disengaging member can slide along the outer wall of the liquid guiding tube so that the dispensing container can move toward the storage container, thereby unlocking the push switch by force.

In addition, the clothing treatment device provided by the present disclosure on the basis of the above technical solutions, due to the use of the clothing treatment agent dispensing assembly described above, has the technical effects of the above clothing treatment agent dispensing assembly; as compared with the clothing treatment devices before improvement, the clothing treatment device of the present disclosure makes it more convenient for the user to put in the clothing treatment agent, and improves the user's experience.

Second Technical Solution

In order to solve the above problem in the prior art, that is, to solve the problem of inconvenient dispensing of the clothing treatment agent of the existing clothing treatment devices, which results in poor user's experience, the present disclosure provides a clothing treatment agent dispensing assembly for a clothing treatment device, in which the clothing treatment device includes a body, and the clothing treatment agent dispensing assembly includes a storage container, a dispensing container, a liquid guiding tube and a sealing member; the storage container is fixed in the body, and the dispensing container is slidably connected to the body; one end of the liquid guiding tube is in communication with the dispensing container, and the other end of the liquid guiding tube is inserted into the storage container; a length of the liquid guiding tube is set such that the other end of the liquid guiding tube will not come out of the storage container when the dispensing container moves away from the storage container; and the sealing member is arranged between the liquid guiding tube and the storage container.

In a preferred technical solution of the above clothing treatment agent dispensing assembly, a guiding structure is provided on the storage container, and the other end of the liquid guiding tube passes through the guiding structure and is inserted into the storage container.

In a preferred technical solution of the above clothing treatment agent dispensing assembly, the sealing member includes a body part, as well as a first sealing part and a second sealing part that are formed on the body part, the first sealing part sealedly abutting against an outer wall of the liquid guiding tube, and the sealing member being sealedly connected to the guiding structure through the second sealing part.

In a preferred technical solution of the above clothing treatment agent dispensing assembly, the sealing member is a sealing ring, and an inner diameter of the body part of the sealing ring is larger than an outer diameter of the liquid guiding tube.

In a preferred technical solution of the above clothing treatment agent dispensing assembly, the first sealing part is a sealing lip formed on an inner wall of the body part of the sealing ring.

In a preferred technical solution of the above clothing treatment agent dispensing assembly, the sealing lip is arranged inclinedly in a direction from the dispensing container to the storage container.

In a preferred technical solution of the above clothing treatment agent dispensing assembly, the sealing ring is sealedly connected to an outer wall of the guiding structure through the second sealing part.

In a preferred technical solution of the above clothing treatment agent dispensing assembly, the second sealing part includes at least one ring-shaped sealing rib or sealing groove formed on an inner wall of the body part of the sealing ring, and the outer wall of the guiding structure is correspondingly provided with at least one ring-shaped sealing groove or sealing rib, in which the ring-shaped sealing rib corresponds to the ring-shaped sealing groove in a one-to-one correspondence, and there is a transitional fit or an interference fit between the ring-shaped sealing rib and the ring-shaped sealing groove so that the sealing ring and the guiding structure are sealedly connected.

In a preferred technical solution of the above clothing treatment agent dispensing assembly, the second sealing part includes a first ring-shaped sealing rib and a second ring-shaped sealing rib that are formed on the inner wall of the body part of the sealing ring, and the outer wall of the guiding structure is correspondingly provided with a first ring-shaped sealing groove and a second ring-shaped sealing groove, in which there is a transitional fit or an interference fit between the first ring-shaped sealing rib and the first ring-shaped sealing groove, and there is a transitional fit or an interference fit between the second ring-shaped sealing rib and the second ring-shaped sealing groove.

In a preferred technical solution of the above clothing treatment agent dispensing assembly, the second sealing part includes at least one ring-shaped sealing rib or sealing groove formed on an outer wall of the body part of the sealing ring, and an inner wall of the guiding structure is correspondingly provided with at least one ring-shaped sealing groove or sealing rib, in which the ring-shaped sealing rib corresponds to the ring-shaped sealing groove in a one-to-one correspondence, and there is a transitional fit or an interference fit between the ring-shaped sealing rib and the ring-shaped sealing groove so that the sealing ring and the guiding structure are sealedly connected.

In a preferred technical solution of the above clothing treatment agent dispensing assembly, the guiding structure is a guide tube joint formed on an outer wall of the storage container.

In another aspect, the present disclosure also provides a clothing treatment device, which includes the clothing treatment agent dispensing assembly described above.

It can be understood by those skilled in the art that in the preferred technical solutions of the present disclosure, the clothing treatment agent dispensing assembly is configured as a split structure, that is, the storage container and the dispensing container are separately provided, and only the dispensing container is slidably connected with the body, so that when the user is putting in the clothing treatment agent, he/she only needs to pull out the dispensing container without also pulling out the storage container, which is labor-saving and fast; moreover, there is a liquid guiding tube between the dispensing container and the storage container, and the other end of the liquid guiding tube is inserted into the storage container; when the dispensing container is being pulled, the liquid guiding tube moves with the dispensing container, but the other end of the liquid guiding tube will not come out of the storage container, so that the liquid guiding tube always makes the dispensing container communicate with the storage container; therefore, when the clothing treatment agent is injected into the dispensing container, the clothing treatment agent can be delivered to the storage container through the liquid guiding tube. Moreover, a sealing member is also provided between the liquid guiding tube and the storage container, and the sealing member can prevent leakage of the clothing treatment agent and improve the user's experience.

Further, the liquid guiding tube is inserted into the storage container through a guiding structure provided on the storage container. The guiding structure guides the liquid guiding tube, which can prevent the liquid guiding tube from deviating during the movement, thereby improving the reliability of the clothing treatment agent dispensing assembly.

Still further, an inner diameter of the body part of the sealing ring is larger than an outer diameter of the liquid guiding tube. Through such an arrangement, installation of the liquid guiding tube is facilitated, and an assembly efficiency of the clothing treatment agent dispensing assembly can be improved.

Still further, the first sealing part is a sealing lip formed on the inner wall of the body part of the sealing ring. By making the sealing lip sealedly abut against the outer wall of the liquid guiding tube, the clothing treatment agent in the storage container can be prevented from leaking along the outer wall of the liquid guiding tube, and when the liquid guiding tube is being pulled out, the sealing lip can scrape off the clothing treatment agent adhered to the outer wall of the liquid guiding tube to prevent the clothing treatment agent from leaking.

Still further, the sealing lip is arranged inclinedly in the direction from the dispensing container to the storage container. Such an arrangement facilitates the liquid guiding tube to pass through the sealing ring smoothly, thereby further improving the assembly efficiency of the clothing treatment agent assembly; moreover, the inwardly inclined sealing lip abuts more closely to the outer wall of the liquid guiding tube, and when the liquid guiding tube is being pulled out, such an arrangement is more advantageous for the sealing lip to scrape off the clothing treatment agent adhered to the outer wall of the liquid guiding tube, thereby further improving the sealing effect of the sealing ring.

Still further, the sealing ring is sealedly connected to the outer wall of the guiding structure through the second sealing part. Such an arrangement can prevent an excessive friction exerted on the outer wall of the liquid guiding tube from affecting the movement of the liquid guiding tube, and can improve the sealing performance of the sealing ring. Specifically, if the sealing ring is arranged between the inner wall of the guiding structure and the outer wall of the liquid guiding tube, the outer wall of the liquid guiding tube will be subjected to a greater friction which will affect the movement of the liquid guiding tube. Therefore, sealedly connecting the sealing ring with the outer wall of the guiding structure can prevent the outer wall of the liquid guiding tube from being subjected to a greater friction. In addition, the clothing treatment agent in the storage container flows to the sealing ring along a gap between the liquid guiding tube and the guiding structure, and a reverse flow is required for the clothing treatment agent before it is able to leak from a possible slit between the sealing ring and the outer wall of the guiding structure, so that the sealing performance of the sealing ring is improved.

Still further, there is a transitional fit or an interference fit between the ring-shaped sealing rib and the ring-shaped sealing groove. Through such an arrangement, the connection stability and sealing performance of the sealing ring and the guiding structure can be improved.

Still further, the second sealing part includes a first ring-shaped sealing rib and a second ring-shaped sealing rib that are formed on the inner wall of the body part of the sealing ring, and the outer wall of the guiding structure is correspondingly provided with a first ring-shaped sealing groove and a second ring-shaped sealing groove, in which there is a transitional fit or an interference fit between the first ring-shaped sealing rib and the first ring-shaped sealing groove, and there is a transitional fit or an interference fit between the second ring-shaped sealing rib and the second ring-shaped sealing groove. By arranging two sets of ring-shaped sealing ribs and ring-shaped sealing grooves, an effect of double guarantee can be achieved, that is, after one set of ring-shaped sealing rib and ring-shaped sealing groove fail, the other set of ring-shaped sealing rib and ring-shaped sealing groove can also be used to connect the sealing ring and the guiding structure in a sealed manner, so that the connection stability and sealing performance between the sealing ring and the guiding structure can be further improved.

In addition, the clothing treatment device provided by the present disclosure on the basis of the above technical solutions, due to the use of the clothing treatment agent dispensing assembly described above, has the technical effects of the above clothing treatment agent dispensing assembly; as compared with the clothing treatment devices before improvement, the clothing treatment device of the present disclosure makes it more convenient for the user to put in the clothing treatment agent, and improves the user's experience.

Third Technical Solution

In order to solve the above problem in the prior art, that is, to solve the problem of inconvenient dispensing of the clothing treatment agent of the existing clothing treatment devices, which results in poor user's experience, the present disclosure provides a clothing treatment agent dispensing assembly for a clothing treatment device, in which the clothing treatment device includes a body, and the clothing treatment agent dispensing assembly includes a storage container, a dispensing container, a liquid guiding tube, a telescopic tube and a push switch; the storage container is fixedly arranged in the body, and the dispensing container is slidably connected to the body; the push switch is arranged to be capable of locking the dispensing container on the body and/or the storage container after the dispensing container is pushed into the body; one end of the liquid guiding tube is in communication with the dispensing container through the telescopic tube, and the other end of the liquid guiding tube is inserted into the storage container; a length of the liquid guiding tube is set such that the other end of the liquid guiding tube will not come out of the storage container when the dispensing container moves away from the storage container; and the telescopic tube can be extended and retracted to allow the dispensing container to move toward the storage container when the liquid guiding tube is stuck or does not move smoothly enough, so as to unlock the push switch and thus enable the push switch to push the dispensing container out.

In a preferred technical solution of the above clothing treatment agent dispensing assembly, the clothing treatment agent dispensing assembly further includes a sealed connection structure, and the sealed connection structure is arranged between the telescopic tube and the dispensing container and/or between the telescopic tube and the liquid guiding tube.

In a preferred technical solution of the above clothing treatment agent dispensing assembly, the sealed connection structure includes a first sealed connection structure, and one end of the telescopic tube is sealedly connected with the dispensing container through the first sealed connection structure.

In a preferred technical solution of the above clothing treatment agent dispensing assembly, the first sealed connection structure includes a first sealed connection part formed on the dispensing container and a second sealed connection part formed on the telescopic tube, one end of the telescopic tube being sealedly connected to the dispensing container through the first sealed connection part and the second sealed connection part.

In a preferred technical solution of the above clothing treatment agent dispensing assembly, the first sealed connection part is a ring-shaped sealing rib or a ring-shaped sealing groove, and correspondingly the second sealed connection part is a ring-shaped sealing groove or a ring-shaped sealing rib, one end of the telescopic tube being sealedly connected to the dispensing container through the ring-shaped sealing rib and the ring-shaped sealing groove.

In a preferred technical solution of the above clothing treatment agent dispensing assembly, the first sealed connection part is a ring-shaped sealing rib formed on an inner wall of the dispensing container, and the second sealed connection part is a ring-shaped sealing groove formed on an outer wall of the telescopic tube.

In a preferred technical solution of the above clothing treatment agent dispensing assembly, the clothing treatment agent dispensing assembly further includes a fixing ring, which is arranged at a connection position between the telescopic tube and the dispensing container, and in an assembled state, an outer wall of the fixing ring abuts against an inner wall of the telescopic tube to prevent the ring-shaped sealing groove and the ring-shaped sealing rib from being separated from each other.

In a preferred technical solution of the above clothing treatment agent dispensing assembly, the fixing ring includes a ring-shaped body and a positioning structure connected to the ring-shaped body, and the positioning structure is arranged to be capable of preventing the fixing ring from moving in the direction of the telescopic tube.

In a preferred technical solution of the above clothing treatment agent dispensing assembly, the positioning structure is a positioning flange which is perpendicularly connected to the ring-shaped body of the fixing ring, and in an assembled state, the positioning flange abuts against an end of the telescopic tube.

In a preferred technical solution of the above clothing treatment agent dispensing assembly, the sealed connection structure further includes a second sealed connection structure, and the other end of the telescopic tube is sealedly connected to one end of the liquid guiding tube through the second sealed connection structure.

In a preferred technical solution of the above clothing treatment agent dispensing assembly, the second sealed connection structure includes a third sealed connection part formed on the telescopic tube and a fourth sealed connection part formed on the liquid guiding tube, and the other end of the telescopic tube is sealedly connected to one end of the liquid guiding tube through the third sealed connection part and the fourth sealed connection part.

In a preferred technical solution of the above clothing treatment agent dispensing assembly, the third sealed connection part is a ring-shaped sealing rib or a ring-shaped sealing groove, and correspondingly the fourth sealed connection part is a ring-shaped sealing groove or a ring-shaped sealing rib, the other end of the telescopic tube being sealedly connected to one end of the liquid guiding tube through the ring-shaped sealing rib and the ring-shaped sealing groove.

In a preferred technical solution of the above clothing treatment agent dispensing assembly, a support structure is provided on the dispensing container, and in an assembled state, the telescopic tube is located above the support structure.

In a preferred technical solution of the above clothing treatment agent dispensing assembly, the support structure is a U-shaped plate, and in an assembled state, the telescopic tube is located in a receiving cavity formed by the U-shaped plate.

In a preferred technical solution of the above clothing treatment agent dispensing assembly, the telescopic tube is a bellows or a telescopic sleeve.

In another aspect, the present disclosure also provides a clothing treatment device, which includes the clothing treatment agent dispensing assembly described above.

It can be understood by those skilled in the art that in the preferred technical solutions of the present disclosure, the clothing treatment agent dispensing assembly is configured as a split structure, that is, the storage container and the dispensing container are separately provided, and only the dispensing container is slidably connected with the body, so that when the user is putting in the clothing treatment agent, he/she only needs to pull out the dispensing container without also pulling out the storage container, which is labor-saving and fast; moreover, there is a liquid guiding tube between the dispensing container and the storage container, and the other end of the liquid guiding tube is inserted into the storage container; when the dispensing container is being pulled, the liquid guiding tube moves with the dispensing container, but the other end of the liquid guiding tube will not come out of the storage container, so that the liquid guiding tube always makes the dispensing container communicate with the storage container; therefore, when the clothing treatment agent is injected into the dispensing container, the clothing treatment agent can be delivered to the storage container through the liquid guiding tube. In addition, by communicating the liquid guiding tube with the dispensing container through the telescopic tube, a situation in which the push switch cannot be unlocked is avoided. Specifically, if the liquid guiding tube is in direct communication with the dispensing container, when the liquid guiding tube is adhered on the inner wall of the storage container by the clothing treatment agent and cannot move, or when the liquid guiding tube is stuck and cannot move, the dispensing container also cannot move, so that no pressure can be applied to the push switch, and therefore the push switch cannot be unlocked. However, in the present disclosure, a telescopic tube is arranged between the liquid guiding tube and the dispensing container. When the above situation occurs in which the liquid guiding tube cannot move, the telescopic tube can be compressed, so that the dispensing container can move toward the storage container to unlock the push switch; moreover, due to the viscous effect of the clothing treatment agent, the movement of the liquid guiding tube may be affected. By providing the telescopic tube, the push switch can be unlocked more quickly to improve the user's experience in use.

Further, one end of the telescopic tube is sealedly connected to the dispensing container through a first sealed connection structure. By connecting the telescopic tube with the dispensing container through the first sealed connection structure, on the basis of connecting the telescopic tube with the dispensing container, the clothing treatment agent can also be prevented from leaking from the connection position between the telescopic tube and the dispensing container.

Still further, a fixing ring is arranged at the connection position between the telescopic tube and the dispensing container, and in an assembled state, the outer wall of the fixing ring abuts against the inner wall of the telescopic tube to prevent the ring-shaped sealing groove and the ring-shaped sealing rib from being separated from each other. The fixing ring provides support and reinforcement, which improves the connection stability and sealing performance between the telescopic tube and the dispensing container.

Still further, a positioning structure is provided on the fixing ring, and the positioning structure can prevent the fixing ring from moving in the direction of the telescopic tube, so that the fixing ring can be positioned at a set position, which improves the reliability of the fixing ring, and further improves the connection stability and sealing performance between the telescopic tube and the dispensing container.

Still further, the other end of the telescopic tube is sealedly connected to one end of the liquid guiding tube through a second sealed connection structure. By sealedly connecting the telescopic tube with the liquid guiding tube through the second sealed connection structure, on the basis of connecting the telescopic tube with the liquid guiding tube, the clothing treatment agent can also be prevented from leaking from the connection position between the telescopic tube and the liquid guiding tube.

Still further, a support structure is provided on the dispensing container, and in an assembled state, the telescopic tube is located above the support structure. By supporting the telescopic tube by the support structure, the telescopic tube can be prevented from being deformed under the action of gravity of the clothing treatment agent, which would otherwise affect the movement of the dispensing container, thereby improving the reliability of the clothing treatment agent dispensing assembly.

In addition, the clothing treatment device provided by the present disclosure on the basis of the above technical solutions, due to the use of the clothing treatment agent dispensing assembly described above, has the technical effects of the above clothing treatment agent dispensing assembly; as compared with the clothing treatment devices before improvement, the clothing treatment device of the present disclosure makes it more convenient for the user to put in the clothing treatment agent, and improves the user's experience.

Fourth Technical Solution

In order to solve the above problem in the prior art, that is, to solve the problem of inconvenient dispensing of the clothing treatment agent of the existing clothing treatment devices, which results in poor user's experience, the present disclosure provides a clothing treatment agent dispensing assembly for a clothing treatment device, in which the clothing treatment device includes a body, and the clothing treatment agent dispensing assembly includes a storage container, a dispensing container, a liquid guiding tube, and an anti-disengaging member; the storage container is fixed in the body, and the dispensing container is slidably connected to the body; one end of the liquid guiding tube is in communication with the dispensing container, and the other end of the liquid guiding tube is inserted into the storage container; a length of the liquid guiding tube is set such that the other end of the liquid guiding tube will not come out of the storage container when the dispensing container moves away from the storage container; and the anti-disengaging member is arranged to be capable of preventing the liquid guiding tube and the dispensing container from being separated from each other.

In a preferred technical solution of the above clothing treatment agent dispensing assembly, one end of the anti-disengaging member is fixedly connected to the dispensing container, and a connection structure between the other end of the anti-disengaging member and the liquid guiding tube is arranged such that when the dispensing container moves away from the storage container, the dispensing container drives the liquid guiding tube to move with the aid of the anti-disengaging member, and that when the dispensing container moves close to the storage container, the anti-disengaging member slides along the outer wall of the liquid guiding tube.

In a preferred technical solution of the above clothing treatment agent dispensing assembly, the connection structure includes a limiting structure provided on the outer wall of the liquid guiding tube and an anti-disengaging structure provided on the other end of the anti-disengaging member; when the dispensing container moves away from the storage container together with the anti-disengaging member, the liquid guiding tube can be driven to move through the cooperation of the limiting structure and the anti-disengaging structure.

In a preferred technical solution of the above clothing treatment agent dispensing assembly, the limiting structure is a ring-shaped limiting rib or a ring-shaped boss formed on an outer wall of the liquid guiding tube, and correspondingly the anti-disengaging structure is a ring-shaped boss or a ring-shaped limiting rib; and in an assembled state, when the dispensing container moves away from the storage container together with the anti-disengaging member, the ring-shaped limiting rib abuts against the ring-shaped boss.

In a preferred technical solution of the above clothing treatment agent dispensing assembly, the dispensing container is provided with a first snap-fit structure, the anti-disengaging member is provided with a second snap-fit structure, and the dispensing container is fixedly connected to one end of the anti-disengaging member through the first snap-fit structure and the second snap-fit structure.

In a preferred technical solution of the above clothing treatment agent dispensing assembly, one of the first snap-fit structure and the second snap-fit structure is a snap-fit protrusion, the other of the first snap-fit structure and the second snap-fit structure is a snap-fit opening, and the snap-fit protrusion matches with the snap-fit opening.

In a preferred technical solution of the above clothing treatment agent dispensing assembly, the clothing treatment agent dispensing assembly further includes a push switch, and the push switch is arranged to be capable of locking the dispensing container on the body and/or the storage container after the dispensing container is pushed into the body.

In a preferred technical solution of the above clothing treatment agent dispensing assembly, the clothing treatment agent dispensing assembly further includes a telescopic tube, one end of the liquid guiding tube is in communication with the dispensing container through the telescopic tube, and the telescopic tube can be extended and retracted to allow the dispensing container to move toward the storage container when the liquid guiding tube is stuck or does not move smoothly enough, so as to unlock the push switch and thus enable the push switch to push the dispensing container out.

In a preferred technical solution of the above clothing treatment agent dispensing assembly, the telescopic tube is a bellows or a telescopic sleeve.

In another aspect, the present disclosure also provides a clothing treatment device, which includes the clothing treatment agent dispensing assembly described above.

It can be understood by those skilled in the art that in the preferred technical solutions of the present disclosure, the clothing treatment agent dispensing assembly is configured as a split structure, that is, the storage container and the dispensing container are separately provided, and only the dispensing container is slidably connected with the body, so that when the user is putting in the clothing treatment agent, he/she only needs to pull out the dispensing container without also pulling out the storage container, which is labor-saving and fast; moreover, there is a liquid guiding tube between the dispensing container and the storage container, and the other end of the liquid guiding tube is inserted into the storage container; when the dispensing container is being pulled, the liquid guiding tube moves with the dispensing container, but the other end of the liquid guiding tube will not come out of the storage container, so that the liquid guiding tube always makes the dispensing container communicate with the storage container; therefore, the clothing treatment agent injected into the dispensing container can be delivered to the storage container through the liquid guiding tube, which improves the user's experience in use. Moreover, by using the anti-disengaging member to prevent the liquid guiding tube and the dispensing container from being separated from each other, the present disclosure also can prevent the liquid guiding tube from completely entering the storage container, thereby improving the reliability of the clothing treatment agent dispensing assembly.

Further, the connection structure between the anti-disengaging member and the liquid guiding tube is arranged such that when the dispensing container moves away from the storage container, the dispensing container drives the liquid guiding tube to move with the aid of the anti-disengaging member. That is, when the dispensing container is being pulled, a pulling force can be applied to the outer wall of the liquid guiding tube through the anti-disengaging member to drive the liquid guiding tube to move, which can avoid affecting the sealing performance at the connection position between the dispensing container and the liquid guiding tube, and can further prevent the leakage of the clothing treatment agent.

Still further, the clothing treatment agent dispensing assembly further includes a push switch, and the push switch is arranged to be capable of locking the dispensing container on the body and/or the storage container after the dispensing container is pushed into the body. By using the push switch to lock the dispensing container on the body and/or the storage container, the dispensing container can be prevented from automatically sliding off the body, thereby improving the safety of the clothing treatment agent dispensing assembly; moreover, when the user needs to add the clothing treatment agent or when it is necessary to clean the dispensing container, it is only required to gently push the dispensing container to unlock the push switch. After the push switch is unlocked, the dispensing container can be automatically pushed out, thereby improving the user's experience in use.

Still further, the clothing treatment agent dispensing assembly further includes a telescopic tube, and one end of the liquid guiding tube is in communication with the dispensing container through the telescopic tube. By communicating the liquid guiding tube with the dispensing container through the telescopic tube, a situation in which the push switch cannot be unlocked is avoided. Specifically, if the liquid guiding tube is in direct communication with the dispensing container, when the liquid guiding tube is adhered on the inner wall of the storage container by the clothing treatment agent and cannot move, or when the liquid guiding tube is stuck and cannot move, the dispensing container also cannot move, so that no pressure can be applied to the push switch, and therefore the push switch cannot be unlocked. However, in the present disclosure, a telescopic tube is arranged between the liquid guiding tube and the dispensing container. When the above situation occurs in which the liquid guiding tube cannot move or the movement is not smooth enough, the telescopic tube can be compressed, so that the dispensing container can move toward the storage container to unlock the push switch; moreover, due to the viscous effect of the clothing treatment agent, the movement of the liquid guiding tube may be affected. By providing the telescopic tube, the push switch can be unlocked more quickly to improve the user's experience in use.

In addition, the clothing treatment device provided by the present disclosure on the basis of the above technical solutions, due to the use of the clothing treatment agent dispensing assembly described above, has the technical effects of the above clothing treatment agent dispensing assembly; as compared with the clothing treatment devices before improvement, the clothing treatment device of the present disclosure makes it more convenient for the user to put in the clothing treatment agent, and improves the user's experience.

BRIEF DESCRIPTION OF DRAWINGS

Hereinafter, preferred embodiments of the present disclosure will be described with reference to the accompanying drawings and in connection with a washing machine. In the drawings.

DETAILED DESCRIPTION

First of all, it should be understood by those skilled in the art that the embodiments to be described below are only used to explain the technical principles of the present disclosure, and are not intended to limit the scope of protection of the present disclosure. For example, although the following embodiments are explained and described in connection with a washing machine, this is not limiting. The technical solutions of the present disclosure are equally applicable to other clothing treatment devices such as an air-washing device, a shoe washing machine and a washing-drying integrated machine. Such changes to the application objects do not depart from the principle and scope of the present disclosure.

It should be noted that in the description of the present disclosure, terms indicating directional or positional relationships, such as "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first", "second", "third" and "fourth" are only used for descriptive purposes, and should not be understood as indicating or implying relative importance.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be internal communication between two elements. For those skilled in the art, the specific meaning of the above terms in the present disclosure can be interpreted according to specific situations.

First Technical Solution

Based on the problem pointed out in the "BACKGROUND OF THE INVENTION" that it is inconvenient to dispense the clothing treatment agent in existing washing machines, which results in poor user's experience, the present disclosure provides a clothing treatment agent dispensing assembly for a washing machine, and a washing machine, aiming at enabling a more convenient operation of dispensing the clothing treatment agent for the user, and thereby improving the user's experience.

Figure 1:
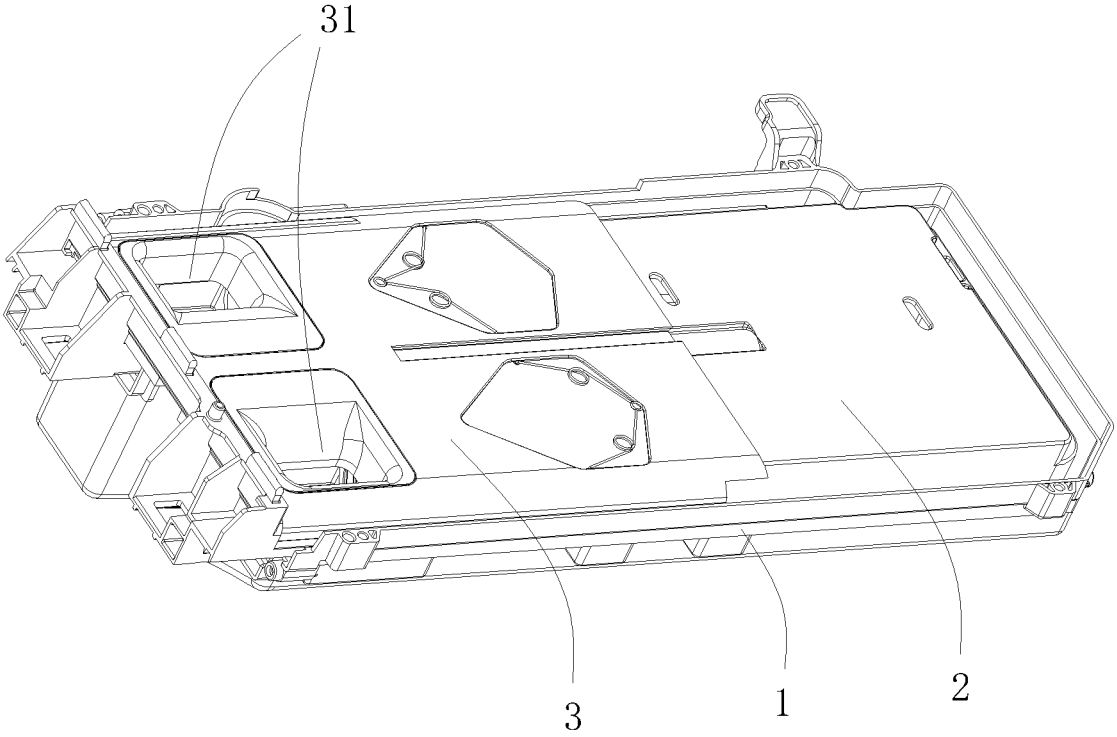
FIG. 1 is a schematic structural view of a clothing treatment agent dispensing assembly according to a first technical solution of the present disclosure.
Figure 2:
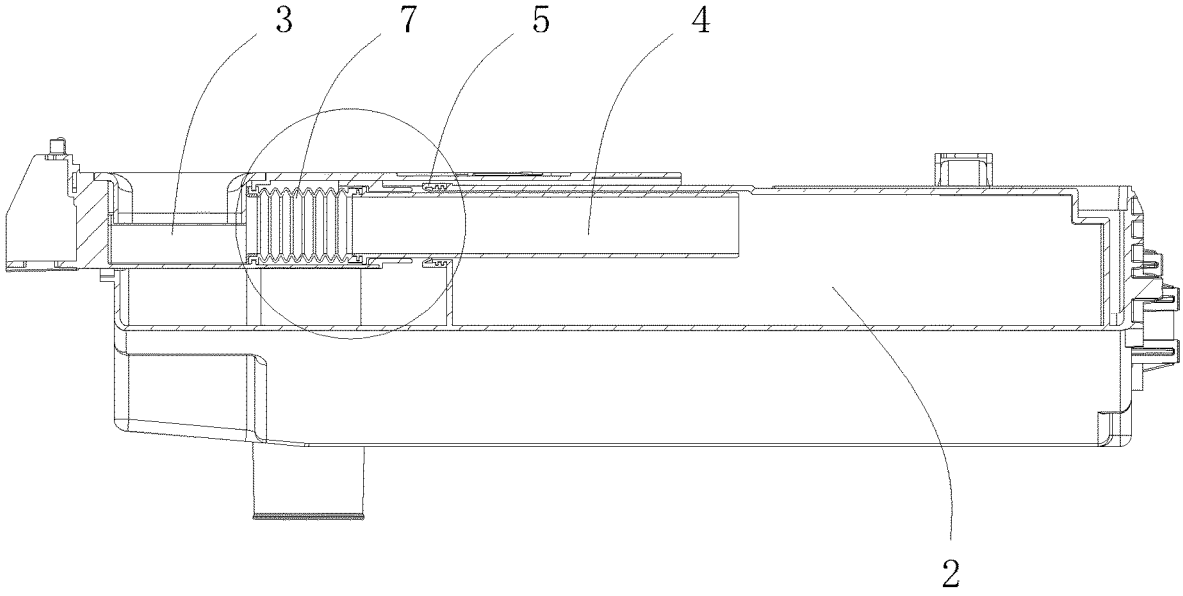
FIG. 2 is a cross-sectional view of the clothing treatment agent dispensing assembly according to the first technical solution of the present disclosure.

Specifically, as shown in FIGS. 1 and 2, the washing machine of the present disclosure includes a body, and the clothing treatment agent dispensing assembly includes a storage container 2, a dispensing container 3, and a liquid guiding tube 4. The storage container 2 is fixed in the body, and the dispensing container 3 is slidably connected to the body. One end of the liquid guiding tube 4 is in communication with the dispensing container 3, and the other end of the liquid guiding tube 4 is inserted into the storage container 2. A length of the liquid guiding tube 4 is set such that the other end of the liquid guiding tube 4 will not come out of the storage container 2 when the dispensing container 3 moves away from the storage container 2. In the present disclosure, the clothing treatment agent dispensing assembly is configured as a split structure, that is, the storage container 2 and the dispensing container 3 are separately provided, and only the dispensing container 3 is slidably connected with the body, so that when the user is adding the clothing treatment agent, he/she only needs to pull out the dispensing container 3 without also pulling out the storage container 2. The dispensing container 3 communicates with the storage container 2 through the liquid guiding tube 4, and a right end of the liquid guiding tube 4 is inserted into the storage container 2. When the dispensing container 3 is being pulled (the dispensing container 3 is moving to the left when viewed in the figure), the liquid guiding tube 4 moves together with the dispensing container 3, but the right end of the liquid guiding tube 4 will not come out of the storage container 2, so that the clothing treatment agent injected into the dispensing container 3 can be delivered into the storage container 2 through the liquid guiding tube 4. After adding the clothing treatment agent, the user pushes the dispensing container 3 and the liquid guiding tube 4 together into the body. A right-side part of the liquid guiding tube 4 is reinserted into the storage container 2.

In addition, it should be noted that as shown in FIG. 1, in order to enable the storage container 2 to be fixed in the body, a receiving box 1 for receiving the storage container 2 and the dispensing container 3 may be provided on the body, and the storage container 2 is fixed at a rear part of the receiving box 1 (a right part of the receiving box 1 when viewed in the figure). When the dispensing container 3 moves to a retracted position, the dispensing container 3 is received at a front part of the receiving box 1 (a left part of the receiving box 1 when viewed in the figure). In addition, the clothing treatment agent includes a detergent and a softener, etc. Such adjustments and changes to the specific kind and specific type of the clothing treatment agent do not depart from the principle and scope of the present disclosure, and should be defined within the scope of protection of the present disclosure.

Figure 5:
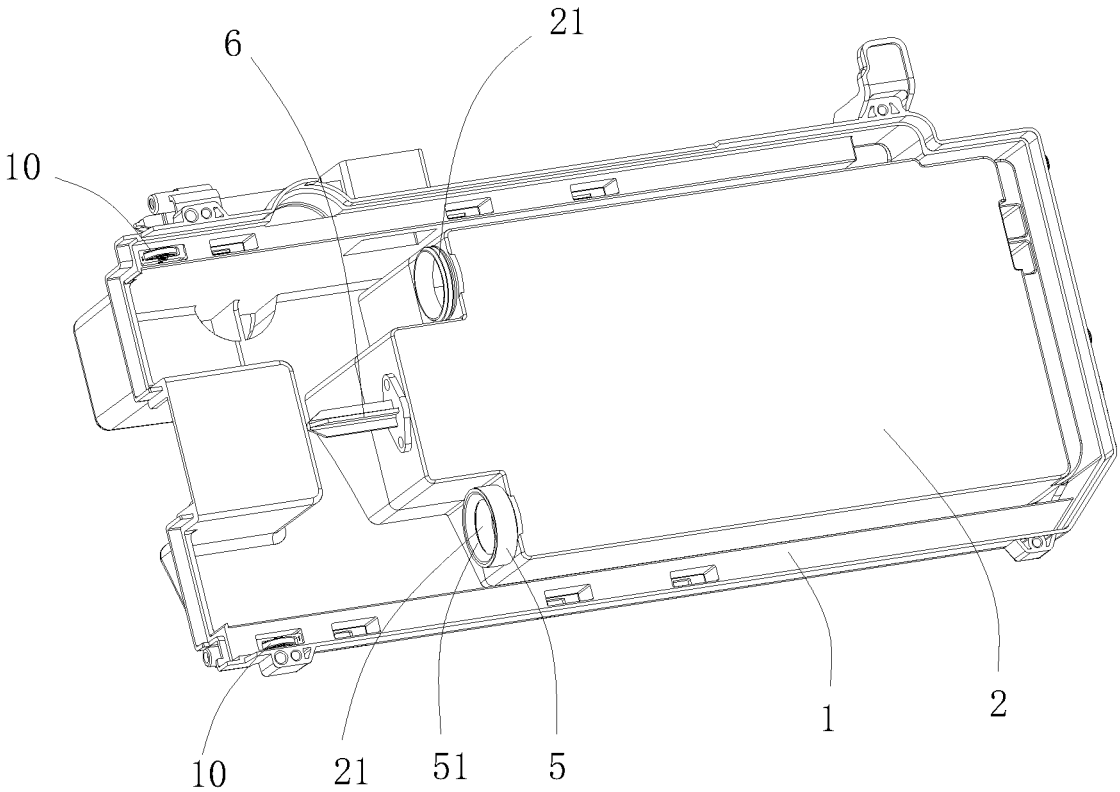
FIG. 5 is a schematic structural view of a storage container, a sealing ring and a push switch of the clothing treatment agent dispensing assembly according to the first technical solution of the present disclosure.
Figure 6:
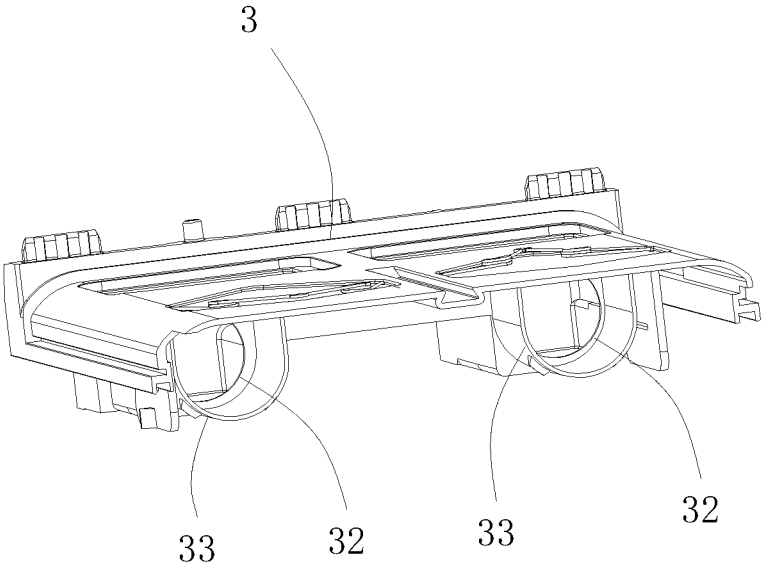
FIG. 6 is a schematic structural view of the dispensing container of the clothing treatment agent dispensing assembly according to the first technical solution of the present disclosure.

In addition, it should also be noted that as shown in FIGS. 1 and 5, two dispensing cavities 31 are provided on the dispensing container 3, one of which is a detergent dispensing cavity, and the other of which is a softener dispensing cavity. Correspondingly, the storage container 2 is provided with two storage cavities: a detergent storage cavity and a softener storage cavity. The detergent dispensing cavity communicates with the detergent storage cavity through one liquid guiding tube 4, and the softener dispensing cavity communicates with the softener storage cavity through another liquid guiding tube 4. Of course, the number of the dispensing cavities 31 is not limited to the above number of two. For example, the number of the dispensing cavities 31 may also be one or three, etc. Such adjustments and changes to the specific number of the dispensing cavities 31 do not depart from the principle and scope of the present disclosure, and should be defined within the scope of protection of the present disclosure.

Preferably, as shown in FIG. 5, the storage container 2 is provided with a guiding structure 21, and the other end of the liquid guiding tube 4 is inserted into the storage container 2 through the guiding structure 21. The guiding structure 21 is a guide tube joint 21 formed on an outer wall of the storage container 2. The right end of the liquid guiding tube 4 is inserted into the storage container 2 through the guide tube joint 21, and when the liquid guiding tube 4 moves with the dispensing container 3, the guide tube joint 21 guides the liquid guiding tube 4. Of course, the guiding structure 21 may also be provided as a guiding rib or a guiding tube and other structures. Such adjustments and changes to the specific structural form of the guiding structure 21 do not depart from the principle and scope of the present disclosure, and should be defined within the scope of protection of the present disclosure.

Figure 3:
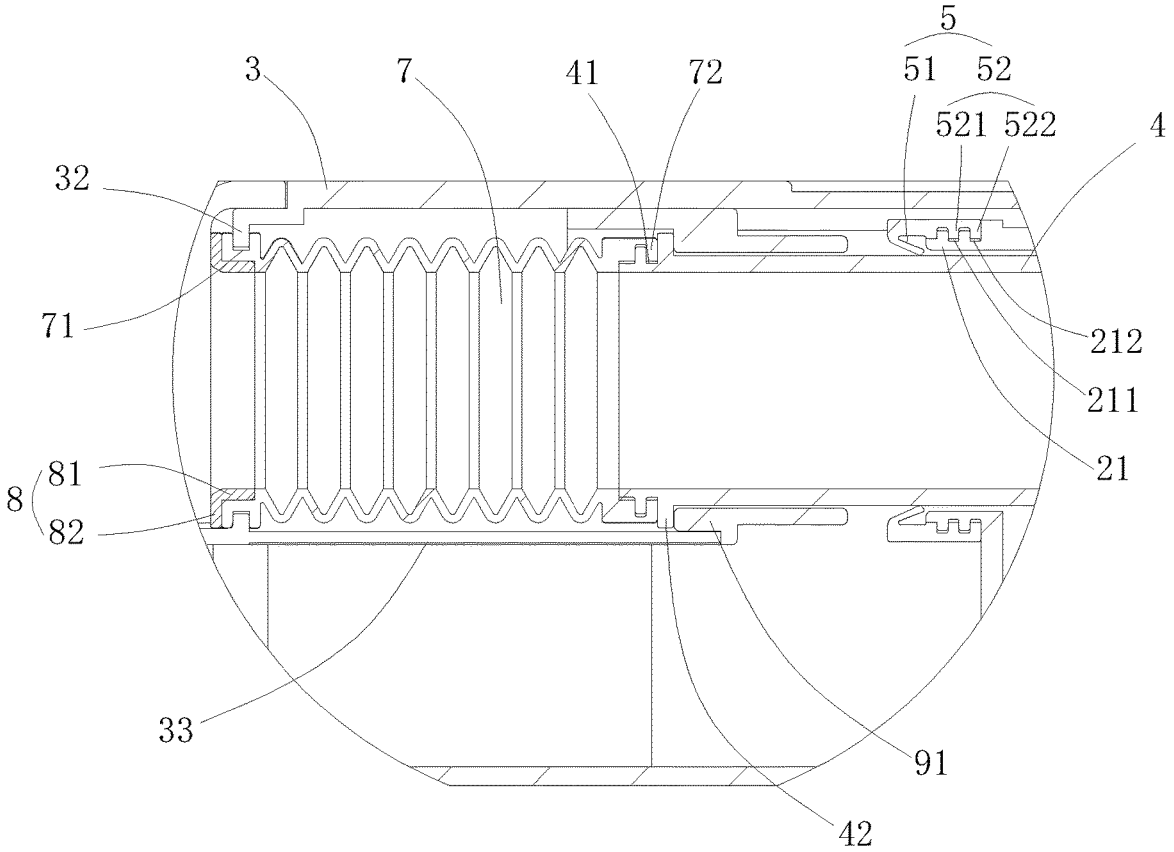
FIG. 3 is a partially enlarged view of FIG. 2.

Preferably, as shown in FIGS. 2, 3 and 5, the clothing treatment agent dispensing assembly further includes a sealing member 5, and the sealing member 5 includes a body part, as well as a first sealing part 51 and a second sealing part 52 that are formed on the body part. The first sealing part 51 abuts against an outer wall of the liquid guiding tube 4 in a sealed manner, and the sealing member 5 is sealedly connected to the guide tube joint 21 through the second sealing part 52. The sealing member 5 is a sealing ring 5, and an inner diameter of the body part of the sealing ring 5 is larger than an outer diameter of the liquid guiding tube 4. Through such an arrangement, the liquid guiding tube 4 can be smoothly inserted into the sealing ring 5.

Preferably, as shown in FIGS. 2, 3 and 5, the first sealing part 51 is a sealing lip 51 formed on an inner wall of the body part of the sealing ring 5. The sealing lip 51 abuts against the outer wall of the liquid guiding tube 4 in a sealed manner, which can prevent the clothing treatment agent in the storage container 2 from leaking along the outer wall of the liquid guiding tube 4; when the liquid guiding tube 4 is being pulled out, the sealing lip 51 can scrape off the clothing treatment agent adhered to the outer wall of the liquid guiding tube 4 to prevent the clothing treatment agent from leaking. Further preferably, the sealing lip 51 is arranged inclinedly in a direction from the dispensing container 3 to the storage container 2. Through such an arrangement, the liquid guiding tube 4 can be smoothly inserted into the sealing ring 5, and the sealing lip 51 can achieve a better sealing effect.

Preferably, as shown in FIGS. 2 and 3, the sealing member 5 is sealedly connected to the outer wall of the guide tube joint 21 through the second sealing part 52. The second sealing part 52 includes at least one ring-shaped sealing rib formed on the inner wall of the body part of the sealing ring 5, and at least one ring-shaped sealing groove is correspondingly provided on the outer wall of the guide tube joint 21. The ring-shaped sealing rib corresponds to the ring-shaped sealing groove in a one-to-one correspondence, and there is a transitional fit or an interference fit between the ring-shaped sealing rib and the ring-shaped sealing groove so that the sealing ring 5 and the guide tube joint 21 are sealedly connected. The at least one ring-shaped sealing rib includes a first ring-shaped sealing rib 521 and a second ring-shaped sealing rib 522, and the at least one ring-shaped sealing groove includes a first ring-shaped sealing groove 211 and a second ring-shaped sealing groove 212; there is a transitional fit or an interference fit between the first ring-shaped sealing rib 521 and the first ring-shaped sealing groove 211, and there is a transitional fit or an interference fit between the second ring-shaped sealing rib 522 and the second ring-shaped sealing groove 212. By arranging two sets of ring-shaped sealing ribs and ring-shaped sealing grooves, an effect of double guarantee can be achieved, that is, after one set of ring-shaped sealing rib and ring-shaped ring-shaped groove fails, the other set of ring-shaped sealing rib and ring-shaped sealing groove can also be used to connect the sealing ring 5 and the guide tube joint 21 in a sealed manner. Of course, the number of the ring-shaped sealing ribs and the ring-shaped sealing grooves is not limited to the above number of two; for example, it may also be one or three, etc. Such adjustments and changes to the specific number of the ring-shaped sealing ribs and ring-shaped sealing grooves do not depart from the principle and scope of the present disclosure, and should be defined within the scope of protection of the present disclosure. In addition, the second sealing part 52 may also include at least one ring-shaped sealing groove formed on the inner wall of the body part of the sealing ring 5, and at least one ring-shaped sealing rib is correspondingly provided on the outer wall of the guide tube joint 21. The ring-shaped sealing rib corresponds to the ring-shaped sealing groove in a one-to-one correspondence, and there is a transitional fit or an interference fit between the ring-shaped sealing rib and the ring-shaped sealing groove to connect the sealing ring 5 and the guide tube joint 21 in a sealed manner.

In addition, as a modification of the above embodiment, the sealing ring 5 may also be connected to the inner wall of the guide tube joint 21 in a sealed manner through the second sealing part 52. In this case, the second sealing part 52 includes at least one ring-shaped sealing rib or sealing groove formed on the outer wall of the body part of the sealing ring 5, and at least one ring-shaped sealing groove or sealing rib is correspondingly provided on the inner wall of the guide tube joint 21; the ring-shaped sealing rib corresponds to the ring-shaped sealing groove in a one-to-one correspondence, and there is a transitional fit or an interference fit between the ring-shaped sealing rib and the ring-shaped sealing groove to connect the sealing ring 5 with the guide tube joint 21 in a sealed manner.

Preferably, as shown in FIG. 5, the clothing treatment agent dispensing assembly further includes a push switch 6, which is arranged to be capable of locking the dispensing container 3 on the body and/or the storage container 2 after the dispensing container 3 is pushed into the body. The push switch 6 includes a moving member, a locking member (not shown in the figure) and a spring (also not shown in the figure). In a possible situation, as shown in FIG. 5, the push switch 6 is arranged between the dispensing container 3 and the storage container 2. One end of the moving member is fixedly connected with the dispensing container 3, and the other end of the moving member is connected with the locking member and the spring that are provided in the storage container 2. After the dispensing container 3 is pushed into the body, the other end of the moving member is locked by the locking member to lock the dispensing container 3 tightly on the storage container 2. When the user needs to add the clothing treatment agent, he/she only needs to gently push the dispensing container 3 in a direction toward the storage container 2. After the push switch 6 is applied a force, the other end of the moving member and the locking member are unlocked, and the dispensing container 3 is pushed out under the action of the spring; of course, the above situation is only exemplary, and the push switch 6 may also be arranged between the dispensing container 3 and the body, or between the dispensing container 3 and the storage container 2 and also between the dispensing container 3 and the body. Such adjustments and changes to the specific arrangement position of the push switch 6 do not depart from the principle and scope of the present disclosure, and should be defined within the scope of protection of the present disclosure. In addition, it should be noted that the specific structure of the push switch 6 is not limited to the above specific structure. Those skilled in the art may flexibly set the specific structure of the push switch 6 in practical applications, and any push switch that can realize locking by being pressed once and realize unlocking by being pressed once more will fall within the scope of protection of the present disclosure.

Figure 7:
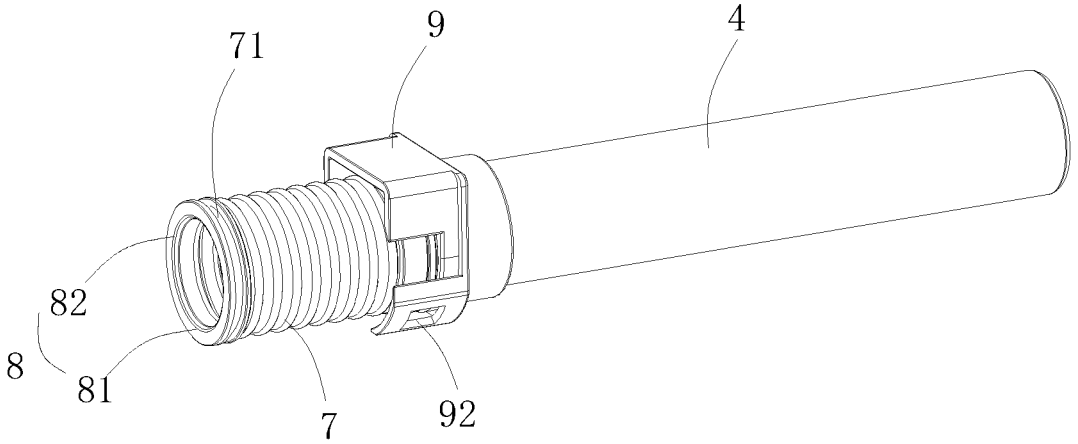
FIG. 7 is a schematic view showing the connection of the liquid guiding tube, a bellows, a fixing ring and an anti-disengaging member of the clothing treatment agent dispensing assembly according to the first technical solution of the present disclosure.

Preferably, as shown in FIGS. 2, 3 and 7, the clothing treatment agent dispensing assembly further includes a telescopic tube 7, one end of the liquid guiding tube 4 is in communication with the dispensing container 3 through the telescopic tube 7, and the telescopic tube 7 can be extended and retracted to allow the dispensing container 3 to move toward the storage container 2 when the liquid guiding tube 4 is stuck or does not move smoothly enough, so as to unlock the push switch 6 and thus enable the push switch 6 to push the dispensing container 3 out. That is, a left end of the liquid guiding tube 4 is fixedly connected to a right end of the telescopic tube 7, and a left end of the telescopic tube 7 is fixedly connected to the dispensing container 3. If the liquid guiding tube 4 cannot move or does not move smoothly enough, when the dispensing container 3 is pushed, the telescopic tube 7 can be compressed so that the dispensing container 3 can move toward the storage container 2, thus unlocking the push switch 6 by force. The telescopic tube 7 is a bellows. Of course, the telescopic tube 7 may also be provided as a telescopic sleeve or a rubber tube. Such flexible adjustments and changes do not depart from the principle and scope of the present disclosure, and should be defined within the scope of protection of the present disclosure.

In addition, it should be noted that although only one embodiment is provided for the push switch 6 and only three embodiments are provided for the telescopic tube 7, it should be understood by those skilled in the art that the contribution of the present disclosure over the prior art is reflected in a combined use of the push switch 6 and the telescopic tube 7, and the scope of protection of the present disclosure should not be limited to the specific structures of the telescopic tube 7 and the push switch 6. Therefore, the use of other structures of the push switch 6 or other types of the telescopic tube 7 will also fall within the scope of protection of the present disclosure.

Preferably, the clothing treatment agent dispensing assembly further includes a sealed connection structure, which is arranged between the telescopic tube 7 and the dispensing container 3 and/or between the telescopic tube 7 and the liquid guiding tube 4. The sealed connection structure may be arranged only between the telescopic tube 7 and the dispensing container 3, or only between the telescopic tube 7 and the liquid guiding tube 4, or between the telescopic tube 7 and the dispensing container 3 and also between the telescopic tube 7 and the liquid guiding tube 4. Such adjustments and changes to the specific arrangement position of the sealed connection structure do not depart from the principle and scope of the present disclosure, and should be defined within the scope of protection of the present disclosure.

Preferably, the sealed connection structure includes a first sealed connection structure, and one end of the telescopic tube 7 is sealedly connected to the dispensing container 3 through the first sealed connection structure. The first sealed connection structure may be arranged only on the telescopic tube 7, or only on the dispensing container 3, or partly on the telescopic tube 7 and partly on the dispensing container 3. Such flexible adjustments and changes do not depart from the principle and scope of the present disclosure, and should be defined within the scope of protection of the present disclosure.

Preferably, as shown in FIGS. 2, 3, 6 and 7, the first sealed connection structure includes a first sealed connection part 32 formed on the dispensing container 3 and a second sealed connection part 71 formed on the telescopic tube 7. One end of the telescopic tube 7 is sealedly connected to the dispensing container 3 through the first sealed connection part 32 and the second sealed connection part 71. The first sealed connection part 32 is a ring-shaped sealing rib formed on the inner wall of the dispensing container 3, and the second sealed connection part 71 is a ring-shaped sealing groove formed on the outer wall of the telescopic tube 7. One end of the telescopic tube 7 is sealedly connected to the dispensing container 3 through the ring-shaped sealing rib and the ring-shaped sealing groove. Of course, the first sealed connection part 32 may also be provided as a ring-shaped sealing groove formed on the dispensing container 3, and correspondingly, the second sealed connection part 71 is provided as a ring-shaped sealing rib formed on the telescopic tube 7. Such flexible adjustments and changes do not depart from the principle and scope of the present disclosure, and should be defined within the scope of protection of the present disclosure.

Preferably, as shown in FIGS. 2, 3, 7 and 9, the clothing treatment agent dispenser assembly further includes a fixing ring 8. The fixing ring 8 is arranged at a connection position between the telescopic tube 7 and the dispensing container 3, and in an assembled state, an outer wall of the fixing ring 8 abuts against the inner wall of the telescopic tube 7 to prevent the ring-shaped sealing groove and the ring-shaped sealing rib from being separated from each other. That is, the fixing ring 8 is supported on the inner wall of the telescopic tube 7 provided with the ring-shaped sealing groove, thereby preventing the telescopic tube 7 from being disengaged from the ring-shaped sealing rib when the telescopic tube 7 is being pulled or pushed due to the deformation of the ring-shaped sealing groove.

Preferably, as shown in FIGS. 2, 3, 7 and 9, the fixing ring 8 includes a ring-shaped body 81 and a positioning structure 82 connected to the ring-shaped body 81. The positioning structure 82 is arranged to be capable of preventing the fixing ring 8 from moving in the direction of the telescopic tube 7. The positioning structure 82 can position the fixing ring 8 at the end of the telescopic tube 7 to prevent the fixing ring 8 from moving to an inward side of the telescopic tube 7 and failing to prevent the ring-shaped sealing groove and the ring-shaped sealing rib from being separated from each other. The positioning structure 82 is a positioning flange 82 which is perpendicularly connected to the ring-shaped body 81 of the fixing ring 8. In an assembled state, the positioning flange 82 abuts against the end of the telescopic tube 7. Of course, the positioning structure 82 may also be provided as a positioning plate or a positioning block and other structures. Such adjustments and changes to the specific structural form of the positioning structure 82 do not depart from the principle and scope of the present disclosure, and should be defined within the scope of protection of the present disclosure.

Preferably, the sealed connection structure further includes a second sealed connection structure, and the other end of the telescopic tube 7 is sealedly connected to one end of the liquid guiding tube 4 through the second sealed connection structure. The second sealed connection structure may be arranged only on the telescopic tube 7, or only on the liquid guiding tube 4, or partly on the telescopic tube 7 and partly on the liquid guiding tube 4. Such flexible adjustments and changes do not depart from the principle and scope of the present disclosure, and should be defined within the scope of protection of the present disclosure.

Figure 8:
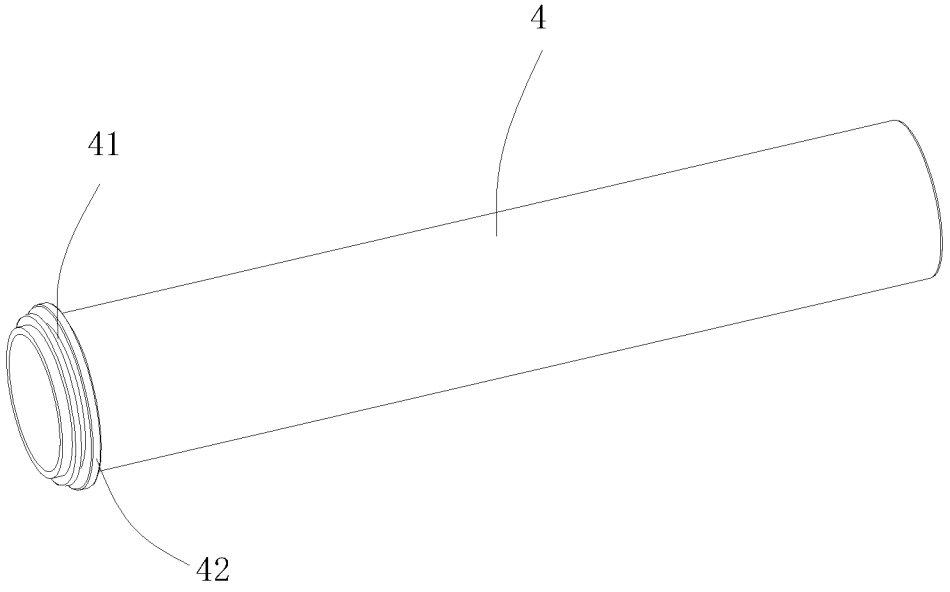
FIG. 8 is a schematic structural view of the liquid guiding tube of the clothing treatment agent dispensing assembly according to the first technical solution of the present disclosure.
Figure 9:
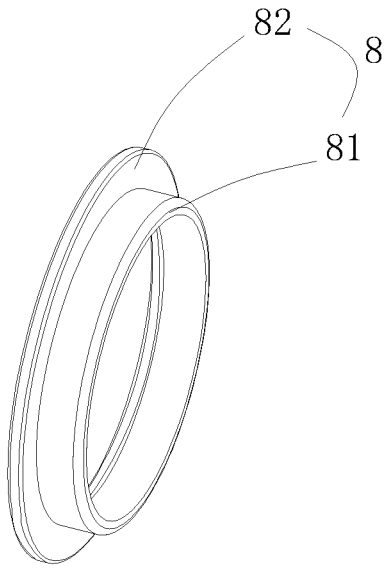
FIG. 9 is a schematic structural view of the fixing ring of the clothing treatment agent dispensing assembly according to the first technical solution of the present disclosure.
Figure 10:
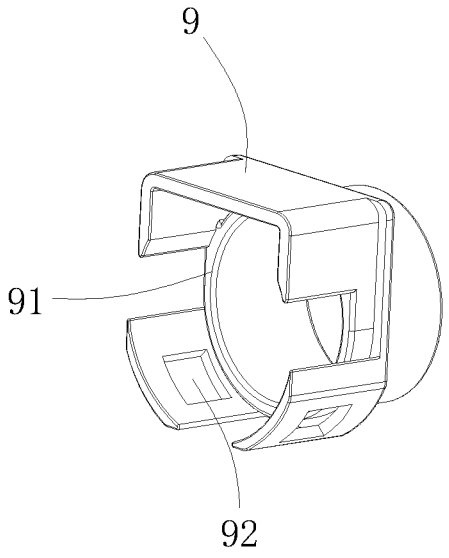
FIG. 10 is a schematic structural view of the anti-disengaging member of the clothing treatment agent dispensing assembly according to the first technical solution of the present disclosure.

Preferably, as shown in FIGS. 2, 3 and 8, the second sealed connection structure includes a third sealed connection part 72 formed on the telescopic tube 7 and a fourth sealed connection part 41 formed on the liquid guiding tube 4. The other end of the telescopic tube 7 is sealedly connected to one end of the liquid guiding tube 4 through the third sealed connection part 72 and the fourth sealed connection part 41. The third sealed connection part 72 is a ring-shaped sealing rib, and correspondingly the fourth sealed connection part 41 is a ring-shaped sealing groove. The other end of the telescopic tube 7 is sealedly connected to one end of the liquid guiding tube 4 through the ring-shaped sealing rib and the ring-shaped sealing groove. Of course, the third sealed connection part 72 may also be provided as a ring-shaped sealing groove, and correspondingly, the fourth sealed connection part 41 is provided as a ring-shaped sealing rib. Such flexible adjustments and changes do not depart from the principle and scope of the present disclosure, and should be defined within the scope of protection of the present disclosure.

Preferably, as shown in FIGS. 2, 3, 4, and 6, a support structure 33 is provided on the dispensing container 3. In an assembled state, the telescopic tube 7 is located above the support structure 33. The support structure 33 is a U-shaped plate 33, and in an assembled state, the telescopic tube 7 is located in a receiving cavity formed by the U-shaped plate 33. The U-shaped plate 33 is fixedly connected to or integrated with the dispensing container 3. Of course, the support structure 33 may also be provided as a support frame or a support seat and other structures. Such adjustments and changes to the specific structural form of the support structure 33 do not depart from the principle and scope of the present disclosure, and should be defined within the scope of protection of the present disclosure.

Figure 4:
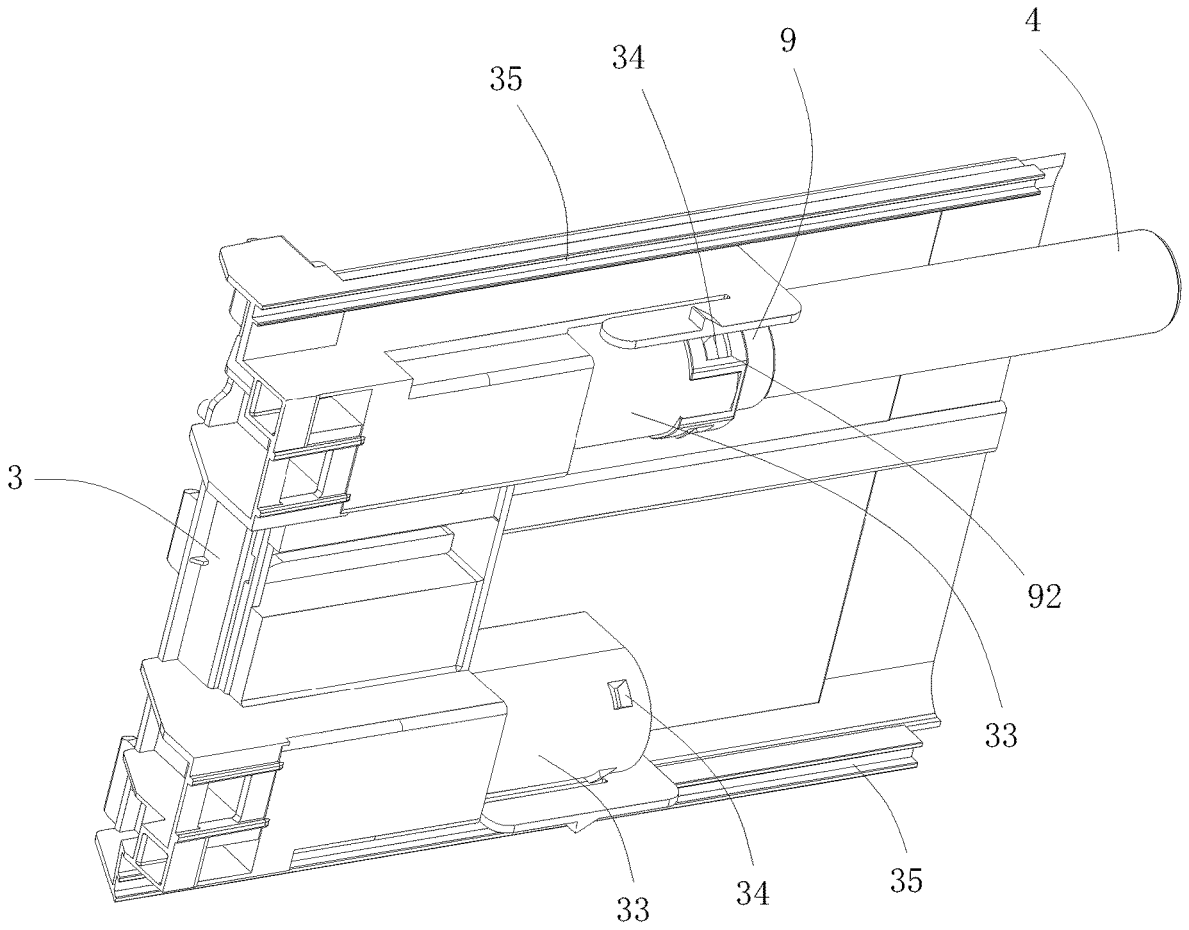
FIG. 4 is a schematic structural view of a dispensing container and a liquid guiding tube of the clothing treatment agent dispensing assembly according to the first technical solution of the present disclosure.

Preferably, as shown in FIGS. 4 and 7, the clothing treatment agent dispensing assembly further includes an anti-disengaging member 9. One end of the anti-disengaging member 9 is fixedly connected to the dispensing container 3, and a connection structure between the other end of the anti-disengaging member 9 and the liquid guiding tube 4 is arranged such that when the dispensing container 3 moves away from the storage container 2, the dispensing container 3 drives the liquid guiding tube 4 to move with the aid of the anti-disengaging member 9, and that when the dispensing container 3 moves close to the storage container 2, the anti-disengaging member 9 slides along the outer wall of the liquid guiding tube 4. That is, one end of the anti-disengaging member 9 is fixedly connected to the dispensing container 3, and the other end of the anti-disengaging member 9 is connected to the outer wall of the liquid guiding tube 4 in a one-way sliding manner A purpose of such an arrangement is to exert a pulling force on the outer wall of the liquid guiding tube 4 through the anti-disengaging member 9 when the dispensing container 3 moves, so as to drive the liquid guiding tube 4 to move, which can avoid affecting the sealing performance at a connection position of the dispensing container 3 and the telescopic tube 7. Specifically, a left end of the telescopic tube 7 is fixedly connected with the dispensing container 3. When the dispensing container 3 is being pulled, the dispensing container 3 and the telescopic tube 7 will tend to separate from each other at the connection position if there is no anti-disengaging member 9 to transmit the pulling force. After a period of use, the sealing performance at the connection position of the dispensing container 3 and the telescopic tube 7 may be reduced; and if the washing machine has not been used for a long time, the clothing treatment agent in the storage container 2 may make the liquid guiding tube 4 stuck to the inner wall of the storage container 2. In this case, a larger pulling force is required to pull the liquid guiding tube 4 out. If there is no anti-disengaging member 9 to transmit the pulling force, the dispensing container 3 and the telescopic tube 7 will have a larger tendency to separate from each other at the connection position, which may damage the sealing performance at the connection position. Therefore, applying the pulling force to the outer wall of the liquid guiding tube 4 by the anti-disengaging member 9 can avoid affecting the sealing performance at the connection position of the dispensing container 3 and the telescopic tube 7, and can also prevent the telescopic tube 7 from being damaged due to increased pulling force. Another purpose of such an arrangement is that when the liquid guiding tube 4 cannot move or does not move smoothly enough, by pushing the dispensing container 3, the anti-disengaging member 9 can slide along the outer wall of the liquid guiding tube 4, so that the dispensing container 3 can move toward the storage container 2, and the push switch 6 is unlocked by force.

In a possible situation, the anti-disengaging member 9 is a fixing seat, a left end of the fixing seat is snap-fit and fixed with the dispensing container 3, and a right end of the fixing seat is provided with an anti-disengaging tube (a length of the anti-disengaging tube is smaller than a length of the liquid guiding tube 4). An inner diameter of the anti-disengaging tube is slightly larger than an outer diameter of the liquid guiding tube 4, and a limiting ring is provided on the outer wall of the liquid guiding tube 4 near the left end (an outer diameter of the limiting ring is larger than the inner diameter of the anti-disengaging tube). A right end of the liquid guiding tube 4 is inserted into the anti-disengaging tube from the left end of the fixing seat and extends out of the anti-disengaging tube until the limiting ring abuts against the end of the anti-disengaging tube. After the left end of the liquid guiding tube 4 communicates with the dispensing container 3, the left end of the fixing seat is snap-fit and fixed with the dispensing container 3. The limiting ring abuts against the end of the anti-disengaging tube to prevent the liquid guiding tube 4 from moving to the right any longer relative to the dispensing container 3, thereby preventing the liquid guiding tube 4 and the dispensing container 3 from being separated from each other. When the dispensing container 3 is being pulled, that is, when the dispensing container 3 moves away from the storage container 2, it can drive the fixing seat to move. The fixing seat transmits the pulling force to the limiting ring provided on the outer wall of the liquid guiding tube 4 through the anti-disengaging tube, so as to drive the liquid guiding tube 4 to move; and when the dispensing container 3 is being pushed, that is, when the dispensing container 3 moves close to the storage container 2, the fixing seat can slide along the outer wall of the liquid guiding tube 4.

In another possible situation, the anti-disengaging member 9 may include a plurality of fixing rods. The fixing rod includes a horizontal rod and a vertical rod. The horizontal rod and the vertical rod are connected perpendicular to each other, that is, arranged in an L shape. There are three fixing rods, which are arranged on the outer wall of the liquid guiding tube 4 in a surrounding manner. The outer wall of the liquid guiding tube 4 is provided with three sliding grooves corresponding to the fixing rods, and ends of the horizontal rods can slide in the sliding grooves in the direction of the liquid guiding tube 4. In an assembled state, the ends of the horizontal rods abut against left ends of the sliding grooves (a side close to the dispensing container 3), and ends of the vertical rods are fixed on the dispensing container 3 by fasteners. Therefore, the liquid guiding tube 4 and the dispensing container 3 can be prevented from being separated from each other. When the dispensing container 3 is being pulled, that is, when the dispensing container 3 moves away from the storage container 2, the fixing rods can be driven to move, and the fixing rods transmit the pulling force to the sliding grooves provided on the outer wall of the liquid guiding tube 4, so as to drive the liquid guiding tube 4 to move; and when the dispensing container 3 is being pushed, that is, when the dispensing container 3 moves close to the storage container 2, the horizontal rods of the fixing rods can slide in the sliding grooves provided on the outer wall of the liquid guiding tube 4. Of course, the above two situations are only exemplary, and should not be considered as limitations to the present disclosure.

Preferably, as shown in FIGS. 2, 3, 8 and 10, the connection structure includes a limiting structure 42 provided on the outer wall of the liquid guiding tube 4 and an anti-disengaging structure 91 provided on the other end of the anti-disengaging member 9. When the dispensing container 3 moves away from the storage container 2 together with the anti-disengaging member 9, the liquid guiding tube 4 can be driven to move through a cooperation of the limiting structure 42 and the anti-disengaging structure 91. The limiting structure 42 is a ring-shaped limiting rib formed on the outer wall of the liquid guiding tube 4, and the anti-disengaging structure 91 is a ring-shaped boss. In an assembled state, when the dispensing container 3 moves away from the storage container 2 together with the anti-disengaging member 9, the ring-shaped limiting rib abuts against the ring-shaped boss. When the dispensing container 3 moves away from the storage container 2 together with the anti-disengaging member 9 (moving to the left as viewed in the figure), the ring-shaped boss abuts against the ring-shaped limiting rib, so that the liquid guiding tube 4 can be driven to move to the left. Of course, the limiting structure 42 may also be provided as a ring-shaped boss, and correspondingly, the anti-disengaging structure 91 may be provided as a ring-shaped limiting rib; or the limiting structure 42 may also be provided as a limiting plate, and the anti-disengaging structure 91 may be provided as an anti-disengaging plate that is adapted to the limiting plate; or the limiting structure 42 is provided as a limiting block, and the anti-disengaging structure 91 is provided as an anti-disengaging bracket adapted to the limiting block, etc. Such adjustments and changes to the specific structural forms of the limiting structure 42 and the anti-disengaging structure 91 do not depart from the principle and scope of the present disclosure, and should be defined within the scope of protection of the present disclosure.

Preferably, as shown in FIGS. 4, 6, 7 and 10, the dispensing container 3 is provided with a first snap-fit structure 34, one end of the anti-disengaging member 9 is provided with a second snap-fit structure 92, and the dispensing container 3 is snap-fit and fixedly connected to one end of the anti-disengaging member 9 through the first snap-fit structure 34 and the second snap-fit structure 92. The first snap-fit structure 34 is a snap-fit protrusion formed on the dispensing container 3, the second snap-fit structure 92 is a snap-fit opening provided on the anti-disengaging member 9, and the snap-fit protrusion matches with the snap-fit opening. Of course, the first snap-fit structure 34 may also be provided as a snap-fit opening, and correspondingly, the second snap-fit structure 92 is provided as a snap-fit protrusion. Such flexible adjustments and changes do not depart from the principle and scope of the present disclosure, and should be defined within the scope of protection of the present disclosure. In addition, the dispensing container 3 and the anti-disengaging member 9 may also be fixed by inserting or riveting, etc. Such adjustments and changes to the specific fixing form of the dispensing container 3 and the anti-disengaging member 9 do not depart from the principle and scope of the present disclosure, and should be defined within the scope of protection of the present disclosure.

Preferably, as shown in FIGS. 4 and 5, a sliding part 35 is provided on the dispensing container 3, a roller 10 that cooperates with the sliding part 35 is provided on the body, and the dispensing container 3 is slidably connected with the body through the sliding part 35 and the roller 10. The sliding part 35 is a sliding groove, which is fixedly connected to or integrated with the dispensing container 3. Of course, the sliding part 35 may also be provided as a slideway or a sliding rail and other structures, as long as the dispensing container 3 can slide relative to the body through a cooperation of the sliding part 35 and the roller 10. Moreover, in addition to the above-mentioned rolling form, a pure sliding form of double sliding rail cooperation, sliding rail and sliding groove cooperation, or sliding rail and slideway cooperation may also be adopted for the slidably connection of the dispensing container 3 and the body. Such changes to the sliding form do not depart from the principle and scope of the present disclosure, and should be defined within the scope of protection of the present disclosure.

Second Technical Solution

Based on the problem pointed out in the "BACKGROUND OF THE INVENTION" that it is inconvenient to dispense the clothing treatment agent in existing washing machines, which results in poor user's experience, the present disclosure provides a clothing treatment agent dispensing assembly for a washing machine, and a washing machine, aiming at enabling a more convenient operation of dispensing the clothing treatment agent for the user, and thereby improving the user's experience.

Specifically, as shown in FIGS. 11 to 14, the washing machine of the present disclosure includes a body, and the clothing treatment agent dispensing assembly includes a storage container 2, a dispensing container 3, a liquid guiding tube 4 and a sealing member 5. The storage container 2 is fixed in the body, and the dispensing container 3 is slidably connected to the body. One end of the liquid guiding tube 4 is in communication with the dispensing container 3, and the other end of the liquid guiding tube 4 is inserted into the storage container 2. A length of the liquid guiding tube 4 is set such that the other end of the liquid guiding tube 4 will not come out of the storage container 2 when the dispensing container 3 moves away from the storage container 2. The sealing member 5 is arranged between the liquid guiding tube 4 and the storage container 2. In the present disclosure, the clothing treatment agent dispensing assembly is configured as a split structure, that is, the storage container 2 and the dispensing container 3 are separately provided, and only the dispensing container 3 is slidably connected with the body, so that when the user is adding the clothing treatment agent, he/she only needs to pull out the dispensing container 3 without also pulling out the storage container 2. The dispensing container 3 communicates with the storage container 2 through the liquid guiding tube 4, and a right end of the liquid guiding tube 4 is inserted into the storage container 2. When the dispensing container 3 is being pulled (the dispensing container 3 is moving to the left when viewed in the figure), the liquid guiding tube 4 moves together with the dispensing container 3, but the right end of the liquid guiding tube 4 will not come out of the storage container 2, so that the clothing treatment agent injected into the dispensing container 3 can be delivered into the storage container 2 through the liquid guiding tube 4. After adding the clothing treatment agent, the user pushes the dispensing container 3 and the liquid guiding tube 4 together into the body. A right-side part of the liquid guiding tube 4 is reinserted into the storage container 2. Moreover, in order to prevent the clothing treatment agent in the storage container 2 from flowing out, a sealing member 5 is also provided between the liquid guiding tube 4 and the storage container 2. The sealing member 5 may be provided as structures such as a sealing ring, a sealing gasket or a sealing rib. Such adjustments and changes to the specific structure of the sealing member 5 do not depart from the principle and scope of the present disclosure, and should be defined within the scope of protection of the present disclosure.

Figure 11:
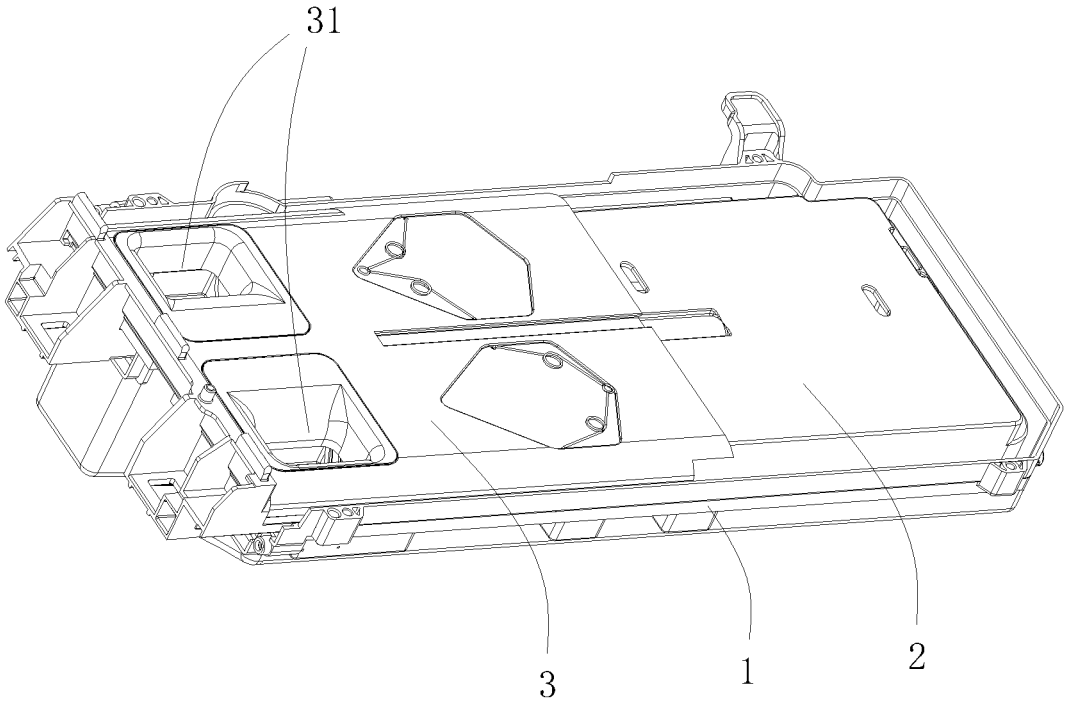
FIG. 11 is a schematic structural view of the clothing treatment agent dispensing assembly according to a second technical solution of the present disclosure.

In addition, it should be noted that as shown in FIG. 11, in order to enable the storage container 2 to be fixed in the body, a receiving box 1 for receiving the storage container 2 and the dispensing container 3 may be provided on the body, and the storage container 2 is fixed at a rear part of the receiving box 1 (a right part of the receiving box 1 when viewed in the figure). When the dispensing container 3 moves to a retracted position, the dispensing container 3 is received at a front part of the receiving box 1 (a left part of the receiving box 1 when viewed in the figure). In addition, the clothing treatment agent includes a detergent and a softener, etc. Such adjustments and changes to the specific kind and specific type of the clothing treatment agent do not depart from the principle and scope of the present disclosure, and should be defined within the scope of protection of the present disclosure.

Figure 14:
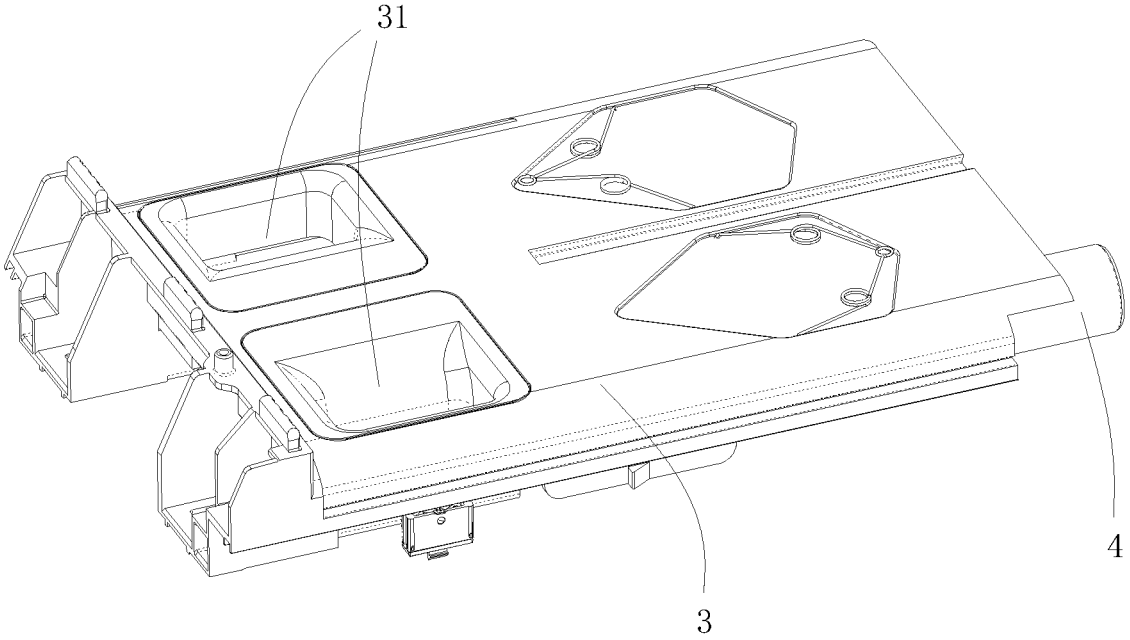
FIG. 14 is a schematic structural view of a dispensing container and a liquid guiding tube of the clothing treatment agent dispensing assembly according to the second technical solution of the present disclosure.
Figure 15:
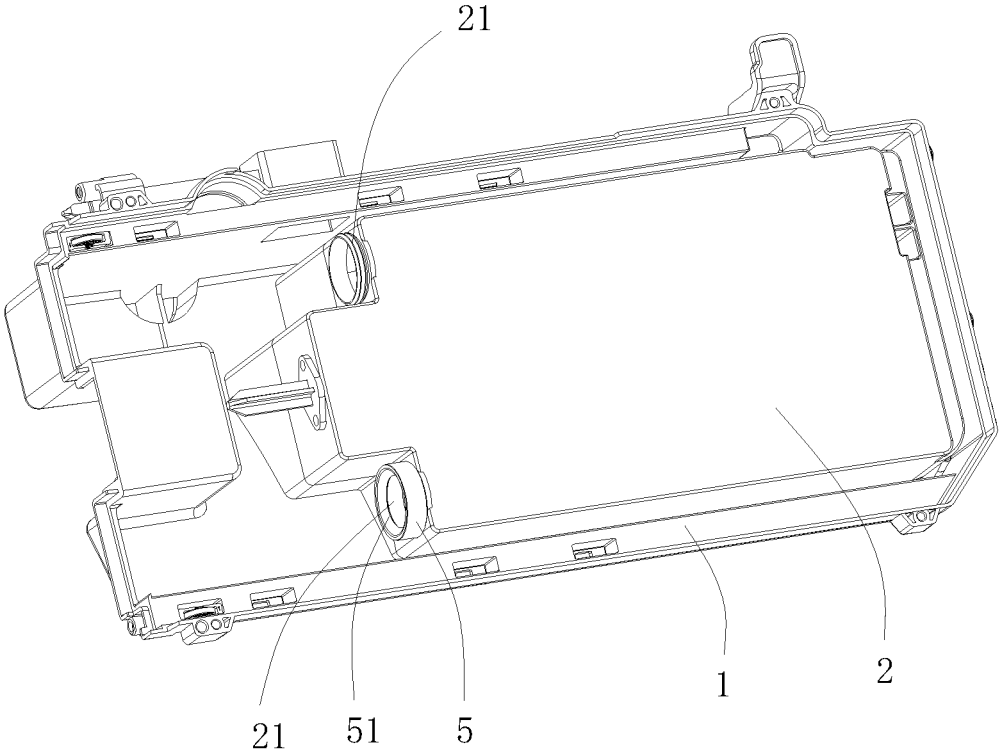
FIG. 15 is a schematic structural view of a storage container and a sealing member of the clothing treatment agent dispensing assembly according to the second technical solution of the present disclosure.

In addition, it should also be noted that as shown in FIGS. 14 and 15, two dispensing cavities 31 are provided on the dispensing container 3, one of which is a detergent dispensing cavity, and the other of which is a softener dispensing cavity. Correspondingly, the storage container 2 is provided with two storage cavities: a detergent storage cavity and a softener storage cavity. The detergent dispensing cavity communicates with the detergent storage cavity through one liquid guiding tube 4, and the softener dispensing cavity communicates with the softener storage cavity through another liquid guiding tube 4. Of course, the number of the dispensing cavities 31 is not limited to the above number of two. For example, the number of the dispensing cavities 31 may also be one or three, etc. Such adjustments and changes to the specific number of the dispensing cavities 31 do not depart from the principle and scope of the present disclosure, and should be defined within the scope of protection of the present disclosure.

Preferably, as shown in FIG. 15, the storage container 2 is provided with a guiding structure 21, and the other end of the liquid guiding tube 4 is inserted into the storage container 2 through the guiding structure 21. The guiding structure 21 is a guide tube joint 21 formed on an outer wall of the storage container 2. The right end of the liquid guiding tube 4 is inserted into the storage container 2 through the guide tube joint 21, and when the liquid guiding tube 4 moves with the dispensing container 3, the guide tube joint 21 guides the liquid guiding tube 4. Of course, the guiding structure 21 may also be provided as a guiding rib or a guiding tube and other structures. Such adjustments and changes to the specific structural form of the guiding structure 21 do not depart from the principle and scope of the present disclosure, and should be defined within the scope of protection of the present disclosure.

Figure 12:
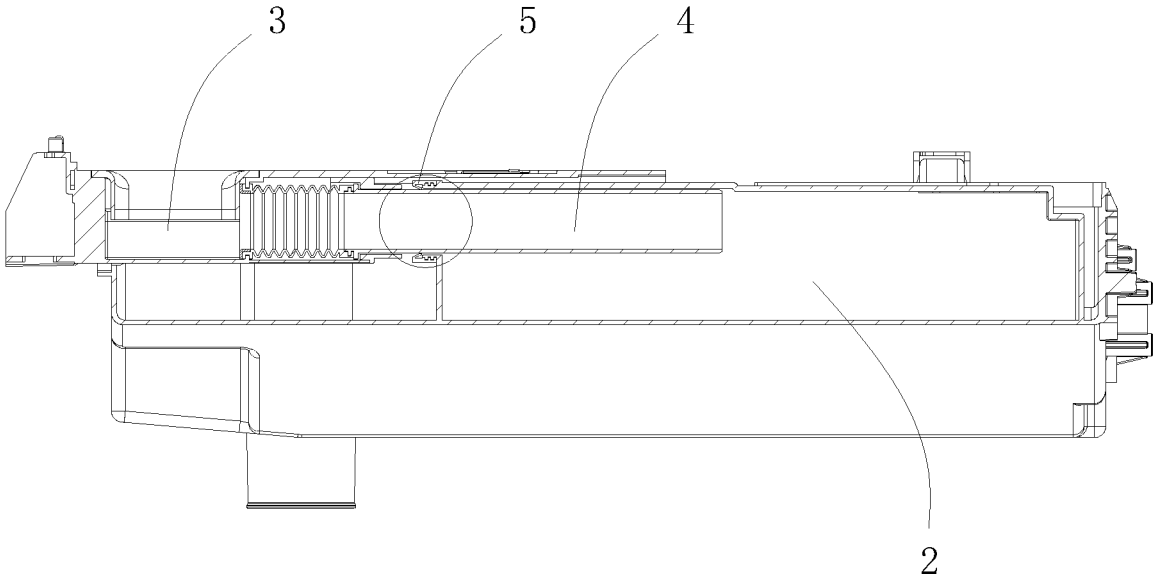
FIG. 12 is a cross-sectional view of the clothing treatment agent dispensing assembly according to the second technical solution of the present disclosure.
Figure 13:
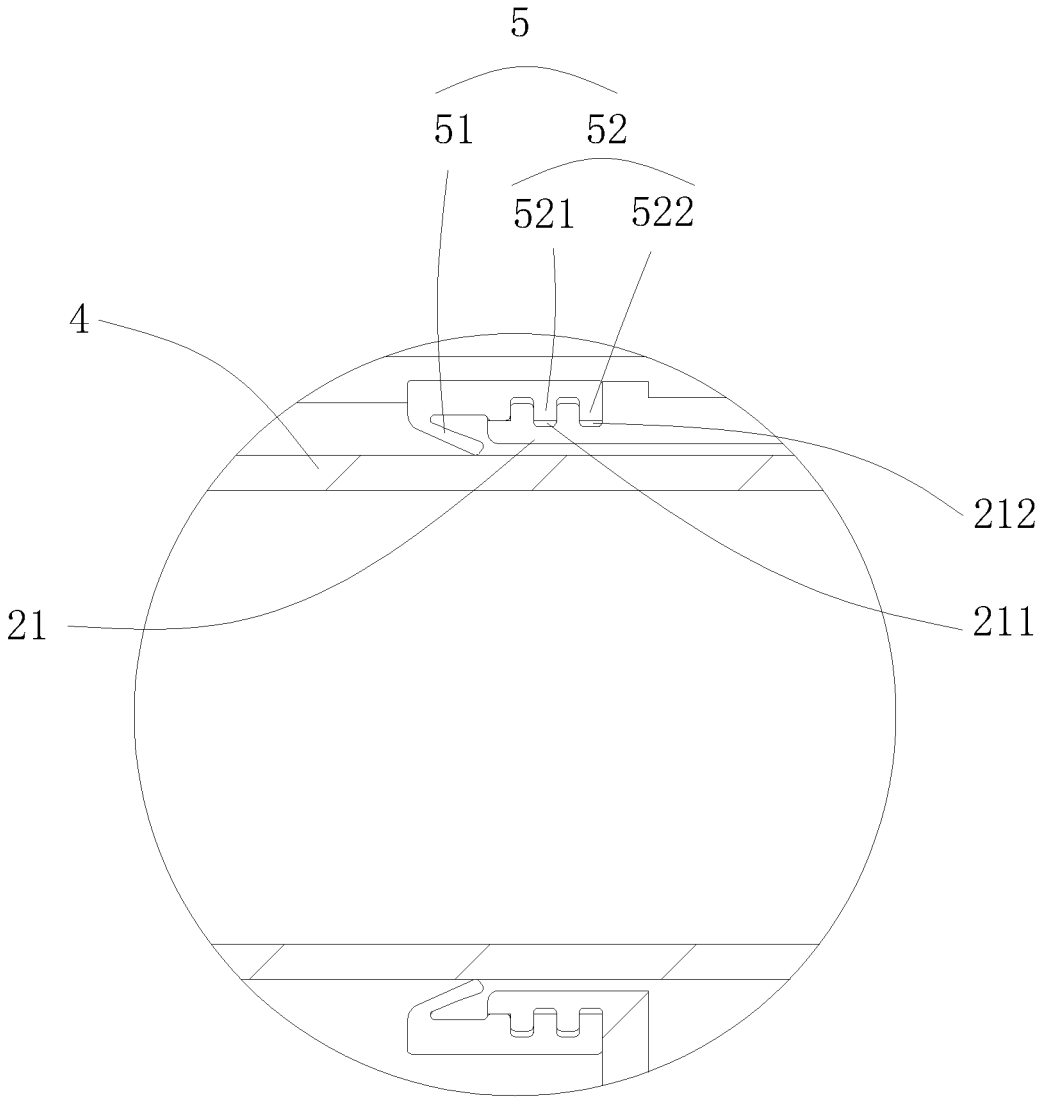
FIG. 13 is a partially enlarged view of FIG. 12.

Preferably, as shown in FIGS. 12, 13 and 15, the sealing member 5 includes a body part, as well as a first sealing part 51 and a second sealing part 52 that are formed on the body part. The first sealing part 51 abuts against an outer wall of the liquid guiding tube 4 in a sealed manner, and the sealing member 5 is sealedly connected to the guide tube joint 21 through the second sealing part 52. The sealing member 5 is a sealing ring 5, and an inner diameter of the body part of the sealing ring 5 is larger than an outer diameter of the liquid guiding tube 4. Through such an arrangement, the liquid guiding tube 4 can be smoothly inserted into the sealing ring 5.

Preferably, as shown in FIGS. 12, 13 and 15, the first sealing part 51 is a sealing lip 51 formed on an inner wall of the body part of the sealing ring 5. The sealing lip 51 abuts against the outer wall of the liquid guiding tube 4 in a sealed manner, which can prevent the clothing treatment agent in the storage container 2 from leaking along the outer wall of the liquid guiding tube 4; when the liquid guiding tube 4 is being pulled out, the sealing lip 51 can scrape off the clothing treatment agent adhered to the outer wall of the liquid guiding tube 4 to prevent the clothing treatment agent from leaking. Further preferably, the sealing lip 51 is arranged inclinedly in a direction from the dispensing container 3 to the storage container 2. Through such an arrangement, the liquid guiding tube 4 can be smoothly inserted into the sealing ring 5, and the sealing lip 51 can achieve a better sealing effect.

Preferably, as shown in FIGS. 12 and 13, the sealing ring 5 is sealedly connected to the outer wall of the guide tube joint 21 through the second sealing part 52. The second sealing part 52 includes at least one ring-shaped sealing rib formed on the inner wall of the body part of the sealing ring 5, and at least one ring-shaped sealing groove is correspondingly provided on the outer wall of the guide tube joint 21. The ring-shaped sealing rib corresponds to the ring-shaped sealing groove in a one-to-one correspondence, and there is a transitional fit or an interference fit between the ring-shaped sealing rib and the ring-shaped sealing groove so that the sealing ring 5 and the guide tube joint 21 are sealedly connected. The at least one ring-shaped sealing rib includes a first ring-shaped sealing rib 521 and a second ring-shaped sealing rib 522, and the at least one ring-shaped sealing groove includes a first ring-shaped sealing groove 211 and a second ring-shaped sealing groove 212; there is a transitional fit or an interference fit between the first ring-shaped sealing rib 521 and the first ring-shaped sealing groove 211, and there is a transitional fit or an interference fit between the second ring-shaped sealing rib 522 and the second ring-shaped sealing groove 212. By arranging two sets of ring-shaped sealing ribs and ring-shaped sealing grooves, an effect of double guarantee can be achieved, that is, after one set of ring-shaped sealing rib and ring-shaped ring-shaped groove fails, the other set of ring-shaped sealing rib and ring-shaped sealing groove can also be used to connect the sealing ring 5 and the guide tube joint 21 in a sealed manner. Of course, the number of the ring-shaped sealing ribs and the ring-shaped sealing grooves is not limited to the above number of two; for example, it may also be one or three, etc. Such adjustments and changes to the specific number of the ring-shaped sealing ribs and ring-shaped sealing grooves do not depart from the principle and scope of the present disclosure, and should be defined within the scope of protection of the present disclosure. Of course, the second sealing part 52 may also include at least one ring-shaped sealing groove formed on the inner wall of the body part of the sealing ring 5, and at least one ring-shaped sealing rib is correspondingly provided on the outer wall of the guide tube joint 21. The ring-shaped sealing rib corresponds to the ring-shaped sealing groove in a one-to-one correspondence, and there is a transitional fit or an interference fit between the ring-shaped sealing rib and the ring-shaped sealing groove to connect the sealing ring 5 and the guide tube joint 21 in a sealed manner.

In addition, as a modification of the above embodiment, the sealing ring 5 may also be connected to the inner wall of the guide tube joint 21 in a sealed manner through the second sealing part 52. In this case, the second sealing part 52 includes at least one ring-shaped sealing rib or sealing groove formed on the outer wall of the body part of the sealing ring 5, and at least one ring-shaped sealing groove or sealing rib is correspondingly provided on the inner wall of the guide tube joint 21; the ring-shaped sealing rib corresponds to the ring-shaped sealing groove in a one-to-one correspondence, and there is a transitional fit or an interference fit between the ring-shaped sealing rib and the ring-shaped sealing groove to connect the sealing ring 5 with the guide tube joint 21 in a sealed manner.

Third Technical Solution

Based on the problem pointed out in the "BACKGROUND OF THE INVENTION" that it is inconvenient to dispense the clothing treatment agent in existing washing machines, which results in poor user's experience, the present disclosure provides a clothing treatment agent dispensing assembly for a washing machine, and a washing machine, aiming at enabling a more convenient operation of dispensing the clothing treatment agent for the user, and thereby improving the user's experience.

Figure 16:
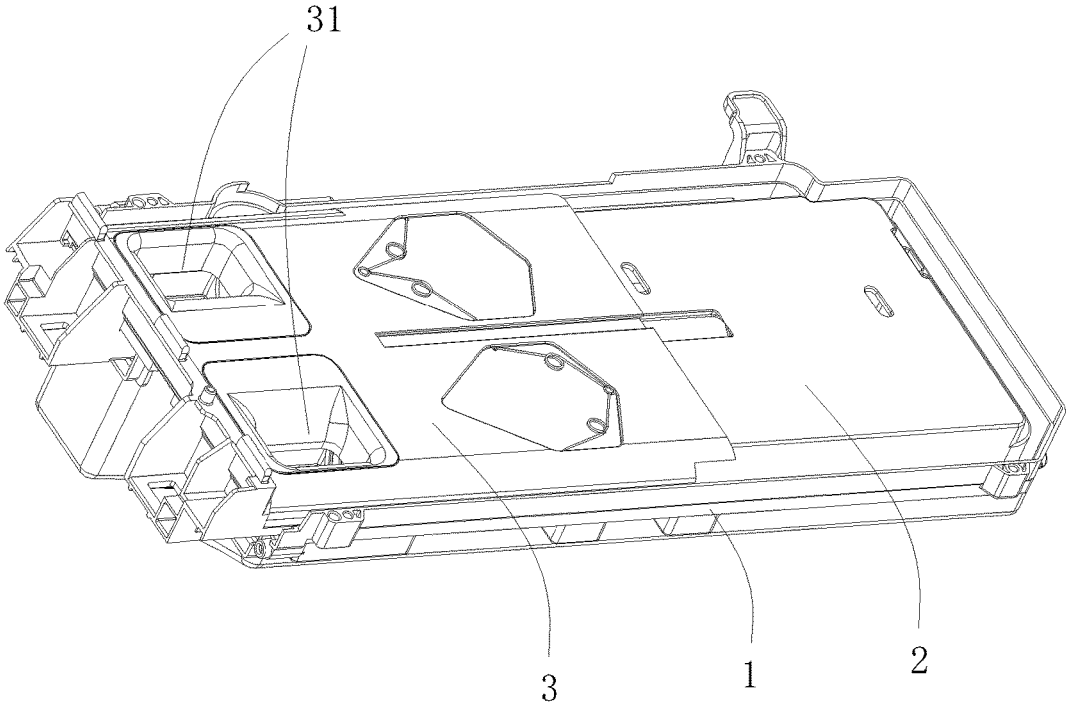
FIG. 16 is a schematic structural view of the clothing treatment agent dispensing assembly according to a third technical solution of the present disclosure.
Figure 17:
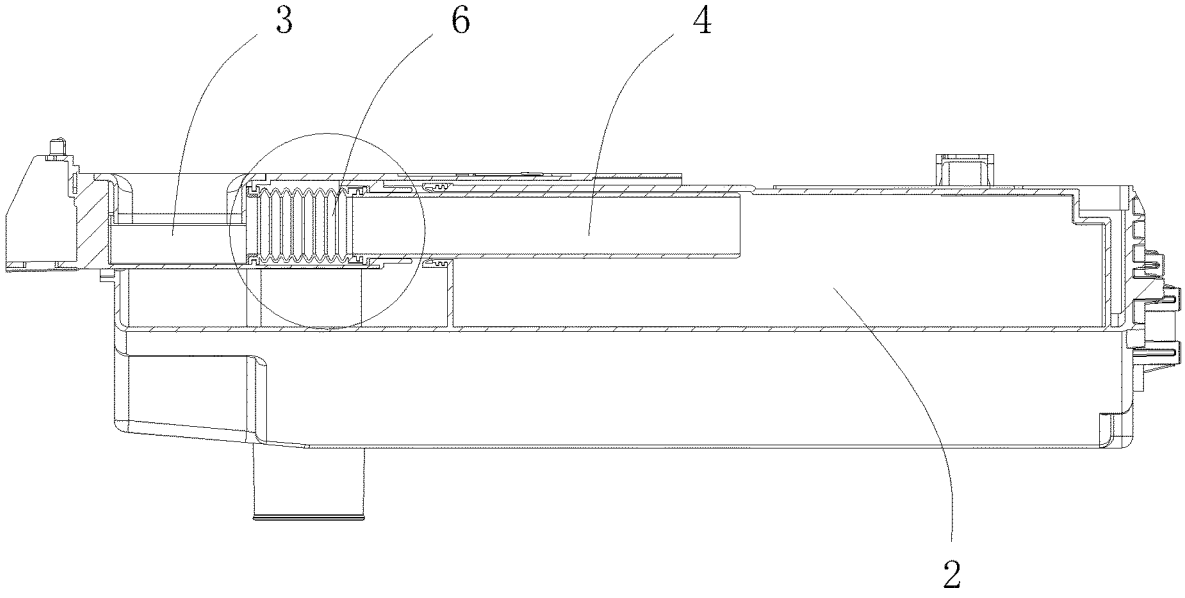
FIG. 17 is a cross-sectional view of the clothing treatment agent dispensing assembly according to the third technical solution of the present disclosure.
Figure 24:
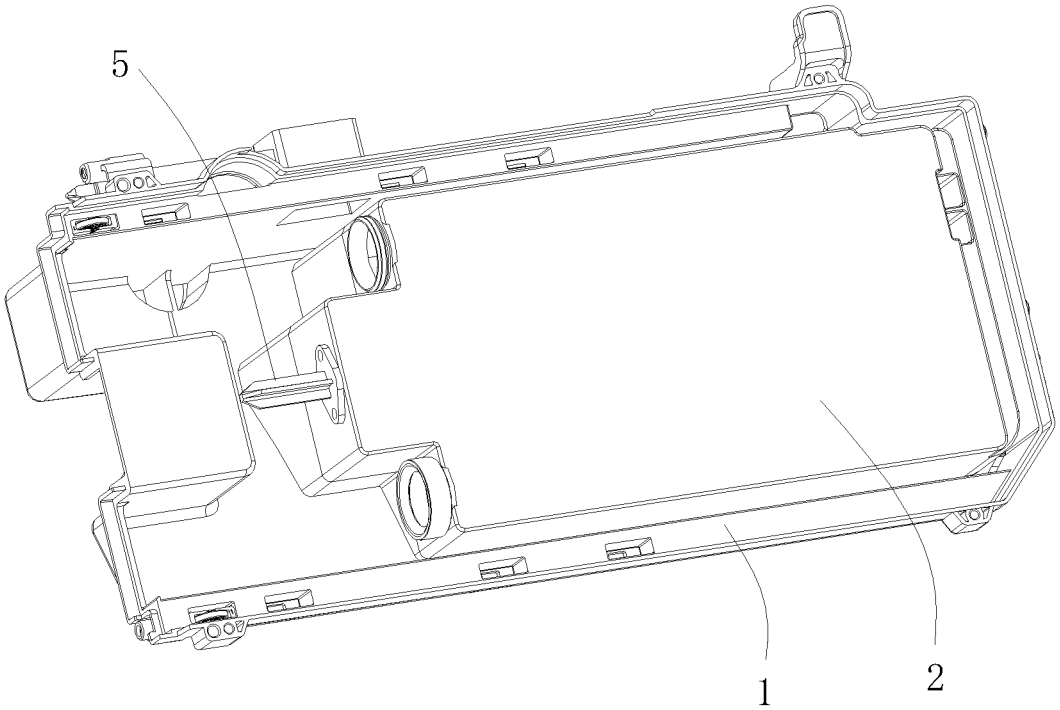
FIG. 24 is a schematic structural view of a storage container of the clothing treatment agent dispensing assembly according to the third technical solution of the present disclosure.

Specifically, as shown in FIGS. 16, 17 and 24, the washing machine of the present disclosure includes a body, and the clothing treatment agent dispensing assembly includes a storage container 2, a dispensing container 3, a liquid guiding tube 4, a telescopic tube 6 and a push switch 5. The storage container 2 is fixedly arranged in the body, and the dispensing container 3 is slidably connected to the body. The push switch 5 is arranged to be capable of locking the dispensing container 3 on the body and/or the storage container 2 after the dispensing container 3 is pushed into the body. One end of the liquid guiding tube 4 is in communication with the dispensing container 3 through the telescopic tube 6, and the other end of the liquid guiding tube 4 is inserted into the storage container 2. A length of the liquid guiding tube 4 is set such that the other end of the liquid guiding tube 4 will not come out of the storage container 2 when the dispensing container 3 moves away from the storage container 2. The telescopic tube 6 can be extended and retracted to allow the dispensing container 3 to move toward the storage container 2 when the liquid guiding tube 4 is stuck or does not move smoothly enough, so as to unlock the push switch 5 and thus enable the push switch 5 to push the dispensing container 3 out. In the present disclosure, the clothing treatment agent dispensing assembly is configured as a split structure, that is, the storage container 2 and the dispensing container 3 are separately provided, and only the dispensing container 3 is slidably connected with the body, so that when the user is putting in the clothing treatment agent, he/she only needs to pull out the dispensing container 3 without also pulling out the storage container 2. The dispensing container 3 communicates with the storage container 2 through the telescopic tube 6 and the liquid guiding tube 4, and a right end of the liquid guiding tube 4 is inserted into the storage container 2. When the dispensing container 3 is being pulled (the dispensing container 3 is moving to the left when viewed in the figure), the telescopic tube 6 and the liquid guiding tube 4 are pulled out together with the dispensing container 3, but the right end of the liquid guiding tube 4 will not come out of the storage container 2, so that the clothing treatment agent injected into the dispensing container 3 can be delivered into the storage container 2 through the telescopic tube 6 and the liquid guiding tube 4. After adding the clothing treatment agent, the user pushes the dispensing container 3, the telescopic tube 6 and the liquid guiding tube 4 together into the body. A right-side part of the liquid guiding tube 4 is inserted into the storage container 2.

The present disclosure is also provided with a push switch 5. The push switch 5 includes a moving member, a locking member (not shown in the figure) and a spring (also not shown in the figure). In a possible situation, as shown in FIG. 24, the push switch 5 is arranged between the dispensing container 3 and the storage container 2. One end of the moving member is fixedly connected with the dispensing container 3, and the other end of the moving member is connected with the locking member and the spring that are provided in the storage container 2. After the dispensing container 3 is pushed into the body, the other end of the moving member is locked by the locking member to lock the dispensing container 3 tightly on the storage container 2. When the user needs to add the clothing treatment agent, he/she only needs to gently push the dispensing container 3 in a direction toward the storage container 2. After the push switch 5 is applied a force, the other end of the moving member and the locking member are unlocked, and the dispensing container 3 is pushed out under the action of the spring; of course, the above situation is only exemplary, and the push switch 5 may also be arranged between the dispensing container 3 and the body, or between the dispensing container 3 and the storage container 2 and also between the dispensing container 3 and the body. Such adjustments and changes to the specific arrangement position of the push switch 5 do not depart from the principle and scope of the present disclosure, and should be defined within the scope of protection of the present disclosure. In addition, it should be noted that the specific structure of the push switch 5 is not limited to the above specific structure. Those skilled in the art may flexibly set the specific structure of the push switch 5 in practical applications, and any push switch that can realize locking by being pressed once and realize unlocking by being pressed once more will fall within the scope of protection of the present disclosure.

In addition, in order to avoid a situation in which the push switch 5 cannot be unlocked, as shown in FIG. 17, the telescopic tube 6 is used in the present disclosure to connect the liquid guiding tube 4 with the dispensing container 3. If the liquid guiding tube 4 cannot move or does not move smoothly enough, when the dispensing container 3 is pushed, the telescopic tube 6 can be compressed so that the dispensing container 3 can move toward the storage container 2, thus unlocking the push switch 5 by force. The telescopic tube 6 is a bellows, a left end of which is in communication with the dispensing container 3, and a right end of which is in communication with the liquid guiding tube 4. Of course, the telescopic tube 6 may also be provided as a telescopic sleeve or a rubber tube. Such adjustments and changes to the specific structure and type of the telescopic tube 6 do not depart from the principle and scope of the present disclosure, and should be defined within the scope of protection of the present disclosure.

In addition, it should be noted that although only one embodiment is provided for the push switch 5 and only three embodiments are provided for the telescopic tube 6, it should be understood by those skilled in the art that the contribution of the present disclosure over the prior art is reflected in a combined use of the push switch 5 and the telescopic tube 6, and the scope of protection of the present disclosure should not be limited to the specific structures of the telescopic tube 6 and the push switch 5. Therefore, the use of other structures of the push switch 5 or telescopic tube 6 will also fall within the scope of protection of the present disclosure.

In addition, it should also be noted that as shown in FIG. 16, in order to enable the storage container 2 to be fixed in the body, a receiving box 1 for receiving the storage container 2 and the dispensing container 3 may be provided on the body, and the storage container 2 is fixed at a rear part of the receiving box 1 (a right part of the receiving box 1 when viewed in the figure). When the dispensing container 3 moves to a retracted position, the dispensing container 3 is received at a front part of the receiving box 1 (a left part of the receiving box 1 when viewed in the figure). In addition, the clothing treatment agent includes a detergent and a softener, etc. Such adjustments and changes to the specific kind and specific type of the clothing treatment agent do not depart from the principle and scope of the present disclosure, and should be defined within the scope of protection of the present disclosure.

In addition, it should also be noted that as shown in FIGS. 16 and 24, two dispensing cavities 31 are provided on the dispensing container 3, one of which is a detergent dispensing cavity, and the other of which is a softener dispensing cavity. Correspondingly, the storage container 2 is provided with two storage cavities: a detergent storage cavity and a softener storage cavity. The detergent dispensing cavity communicates with the detergent storage cavity through one set of the liquid guiding tube 4 and telescopic tube 6, and the softener dispensing cavity communicates with the softener storage cavity through another set of the liquid guiding tube 4 and telescopic tube 6. Of course, the number of the dispensing cavities 31 is not limited to the above number of two. For example, the number of the dispensing cavities 31 may also be one or three, etc. Such adjustments and changes to the specific number of the dispensing cavities 31 do not depart from the principle and scope of the present disclosure, and should be defined within the scope of protection of the present disclosure.

Preferably, the clothing treatment agent dispensing assembly further includes a sealed connection structure, which is arranged between the telescopic tube 6 and the dispensing container 3 and/or between the telescopic tube 6 and the liquid guiding tube 4. The sealed connection structure may be arranged only between the telescopic tube 6 and the dispensing container 3, or only between the telescopic tube 6 and the liquid guiding tube 4, or between the telescopic tube 6 and the dispensing container 3 and also between the telescopic tube 6 and the liquid guiding tube 4. Such adjustments and changes to the specific arrangement position of the sealed connection structure do not depart from the principle and scope of the present disclosure, and should be defined within the scope of protection of the present disclosure.

Preferably, the sealed connection structure includes a first sealed connection structure, and one end of the telescopic tube 6 is sealedly connected to the dispensing container 3 through the first sealed connection structure. The first sealed connection structure may be arranged only on the telescopic tube 6, or only on the dispensing container 3, or partly on the telescopic tube 6 and partly on the dispensing container 3. Such flexible adjustments and changes do not depart from the principle and scope of the present disclosure, and should be defined within the scope of protection of the present disclosure.

Preferably, as shown in FIGS. 17 to 21, the first sealed connection structure includes a first sealed connection part 32 formed on the dispensing container 3 and a second sealed connection part 61 formed on the telescopic tube 6. One end of the telescopic tube 6 is sealedly connected to the dispensing container 3 through the first sealed connection part 32 and the second sealed connection part 61. The first sealed connection part 32 is a ring-shaped sealing rib formed on the inner wall of the dispensing container 3, and the second sealed connection part 61 is a ring-shaped sealing groove formed on the outer wall of the telescopic tube 6. One end of the telescopic tube 6 is sealedly connected to the dispensing container 3 through the ring-shaped sealing rib and the ring-shaped sealing groove. Of course, the first sealed connection part 32 may also be provided as a ring-shaped sealing groove formed on the dispensing container 3, and correspondingly, the second sealed connection part 61 is provided as a ring-shaped sealing rib formed on the telescopic tube 6. Such flexible adjustments and changes do not depart from the principle and scope of the present disclosure, and should be defined within the scope of protection of the present disclosure.

Preferably, as shown in FIGS. 17 to 21, the clothing treatment agent dispenser assembly further includes a fixing ring 7. The fixing ring 7 is arranged at a connection position between the telescopic tube 6 and the dispensing container 3, and in an assembled state, an outer wall of the fixing ring 7 abuts against the inner wall of the telescopic tube 6 to prevent the ring-shaped sealing groove and the ring-shaped sealing rib from being separated from each other. That is, the fixing ring 7 is supported on the inner wall of the telescopic tube 6 provided with the ring-shaped sealing groove, thereby preventing the telescopic tube 6 from being disengaged from the ring-shaped sealing rib when the telescopic tube 6 is being pulled or pushed due to the deformation of the ring-shaped sealing groove.

Preferably, as shown in FIGS. 17 to 21, the fixing ring 7 includes a ring-shaped body 71 and a positioning structure 72 connected to the ring-shaped body 71. The positioning structure 72 is arranged to be capable of preventing the fixing ring 7 from moving in the direction of the telescopic tube 6. The positioning structure 72 can position the fixing ring 7 at the end of the telescopic tube 6 to prevent the fixing ring 7 from moving to an inward side of the telescopic tube 6 and failing to prevent the ring-shaped sealing groove and the ring-shaped sealing rib from being separated from each other. The positioning structure 72 is a positioning flange 72 which is perpendicularly connected to the ring-shaped body 71 of the fixing ring 7. In an assembled state, the positioning flange 72 abuts against the end of the telescopic tube 6. Of course, the positioning structure 72 may also be provided as a positioning plate or a positioning block and other structures. Such adjustments and changes to the specific structural form of the positioning structure 72 do not depart from the principle and scope of the present disclosure, and should be defined within the scope of protection of the present disclosure.

Preferably, the sealed connection structure further includes a second sealed connection structure, and the other end of the telescopic tube 6 is sealedly connected to one end of the liquid guiding tube 4 through the second sealed connection structure. The second sealed connection structure may be arranged only on the telescopic tube 6, or only on the liquid guiding tube 4, or partly on the telescopic tube 6 and partly on the liquid guiding tube 4. Such flexible adjustments and changes do not depart from the principle and scope of the present disclosure, and should be defined within the scope of protection of the present disclosure.

Figure 18:
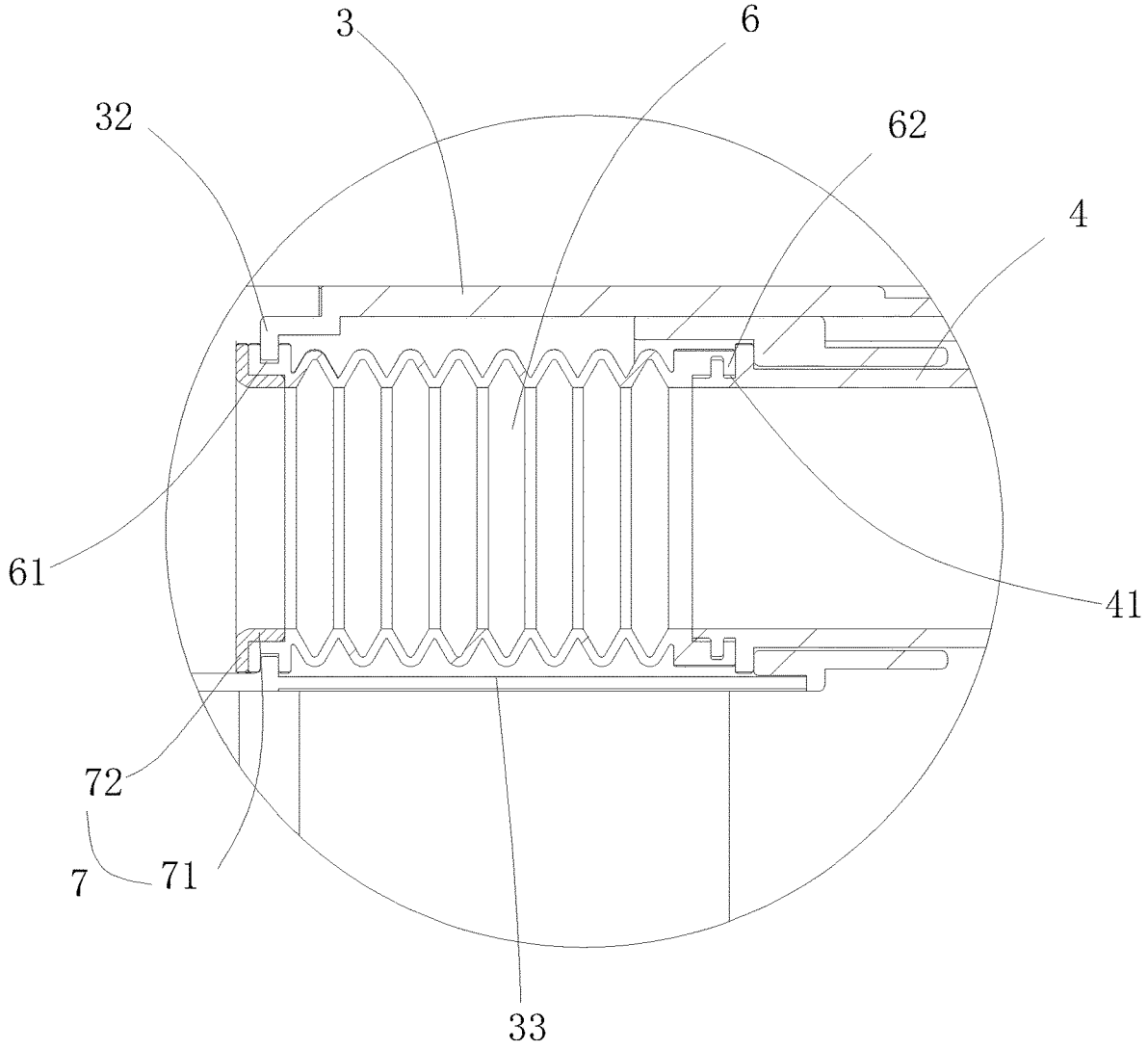
FIG. 18 is a partially enlarged view of FIG. 17.
Figure 19:
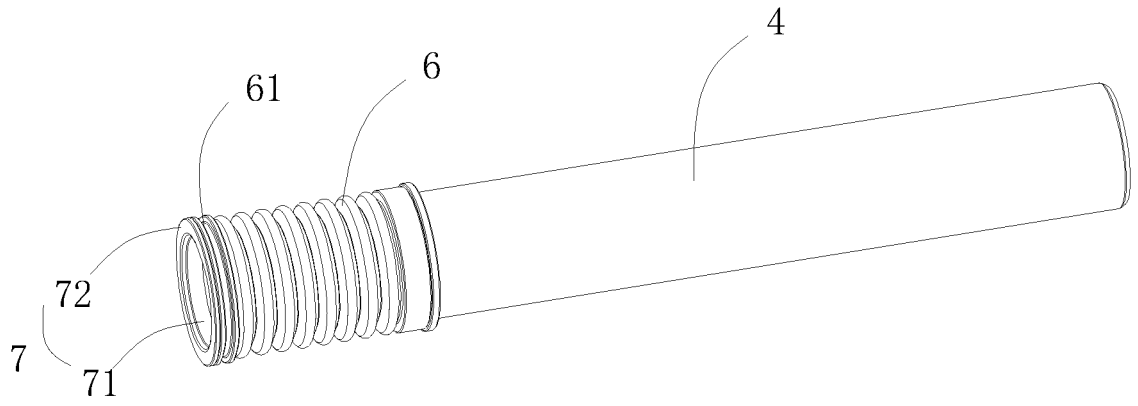
FIG. 19 is a schematic view showing the connection of a liquid guiding tube, a bellows and a fixing ring of the clothing treatment agent dispensing assembly according to the third technical solution of the present disclosure.
Figure 20:
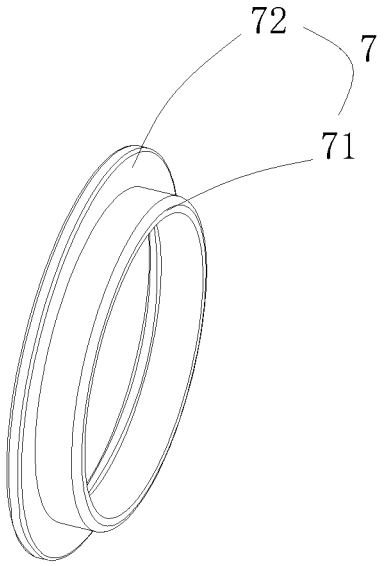
FIG. 20 is a schematic structural view of the fixing ring of the clothing treatment agent dispensing assembly according to the third technical solution of the present disclosure.
Figure 21:
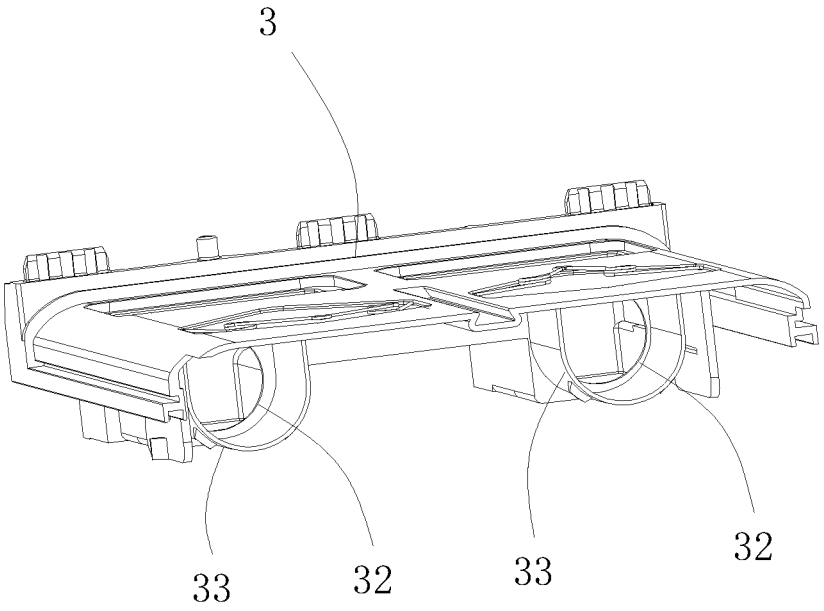
FIG. 21 is a schematic structural view of a dispensing container of the clothing treatment agent dispensing assembly according to the third technical solution of the present disclosure.
Figure 22:
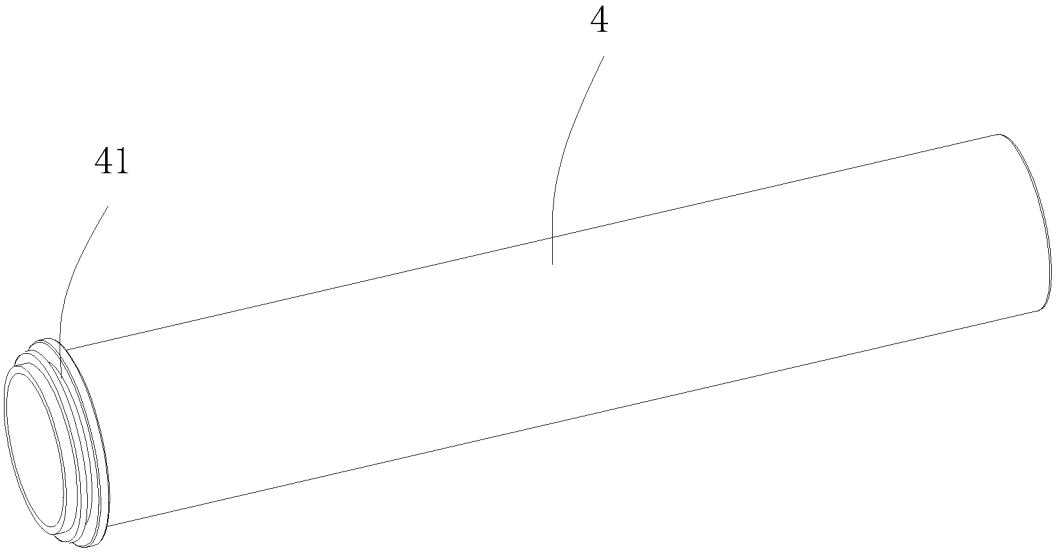
FIG. 22 is a schematic structural view of the liquid guiding tube of the clothing treatment agent dispensing assembly according to the third technical solution of the present disclosure.
Figure 23:
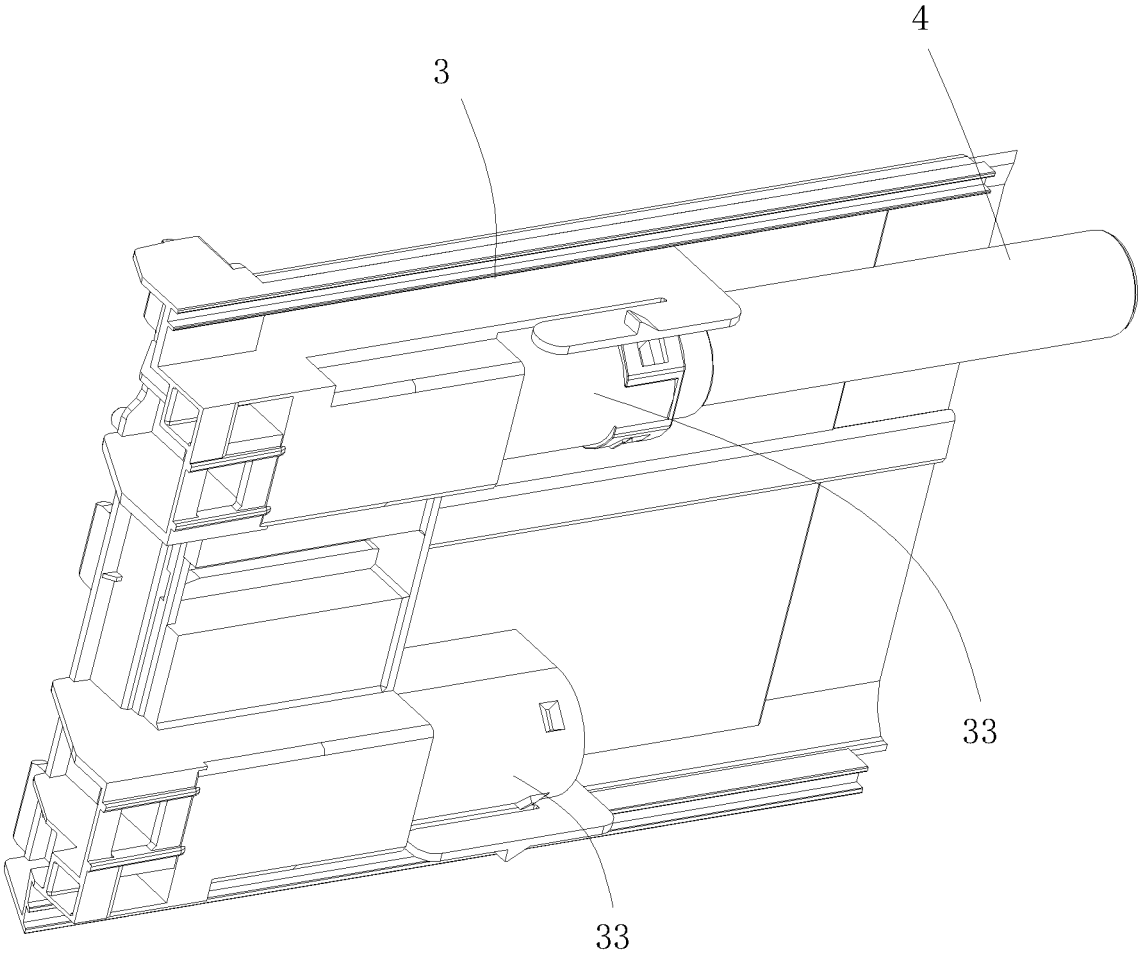
FIG. 23 is a schematic view showing the connection of the dispensing container and the liquid guiding tube of the clothing treatment agent dispensing assembly according to the third technical solution of the present disclosure.

Preferably, as shown in FIGS. 17 and 18, the second sealed connection structure includes a third sealed connection part 62 formed on the telescopic tube 6 and a fourth sealed connection part 41 formed on the liquid guiding tube 4. The other end of the telescopic tube 6 is sealedly connected to one end of the liquid guiding tube 4 through the third sealed connection part 62 and the fourth sealed connection part 41. The third sealed connection part 62 is a ring-shaped sealing rib, and correspondingly the fourth sealed connection part 41 is a ring-shaped sealing groove. The other end of the telescopic tube 6 is sealedly connected to one end of the liquid guiding tube 4 through the ring-shaped sealing rib and the ring-shaped sealing groove. Of course, the third sealed connection part 62 may also be provided as a ring-shaped sealing groove, and correspondingly, the fourth sealed connection part 41 is provided as a ring-shaped sealing rib. Such flexible adjustments and changes do not depart from the principle and scope of the present disclosure, and should be defined within the scope of protection of the present disclosure.

Preferably, as shown in FIGS. 17, 18, 21 and 23, a support structure 33 is provided on the dispensing container 3. In an assembled state, the telescopic tube 6 is located above the support structure 33. The support structure 33 is a U-shaped plate 33, and in an assembled state, the telescopic tube 6 is located in a receiving cavity formed by the U-shaped plate 33. The U-shaped plate 33 is fixedly connected to or integrated with the dispensing container 3. Of course, the support structure 33 may also be provided as a support frame or a support seat and other structures. Such adjustments and changes to the specific structural form of the support structure 33 do not depart from the principle and scope of the present disclosure, and should be defined within the scope of protection of the present disclosure.

Fourth Technical Solution

Based on the problem pointed out in the "BACKGROUND OF THE INVENTION" that it is inconvenient to dispense the clothing treatment agent in existing washing machines, which results in poor user's experience, the present disclosure provides a clothing treatment agent dispensing assembly for a washing machine, and a washing machine, aiming at enabling a more convenient operation of dispensing the clothing treatment agent for the user, and thereby improving the user's experience.

Figure 25:
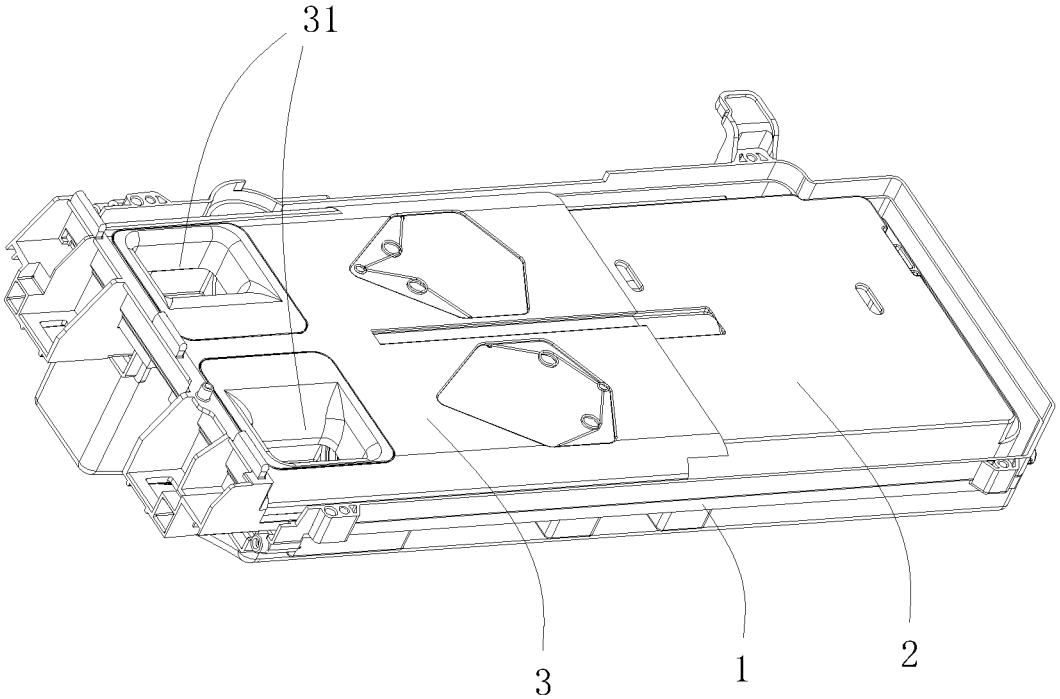
FIG. 25 is a schematic structural view of the clothing treatment agent dispensing assembly according to a fourth technical solution of the present disclosure.
Figure 26:
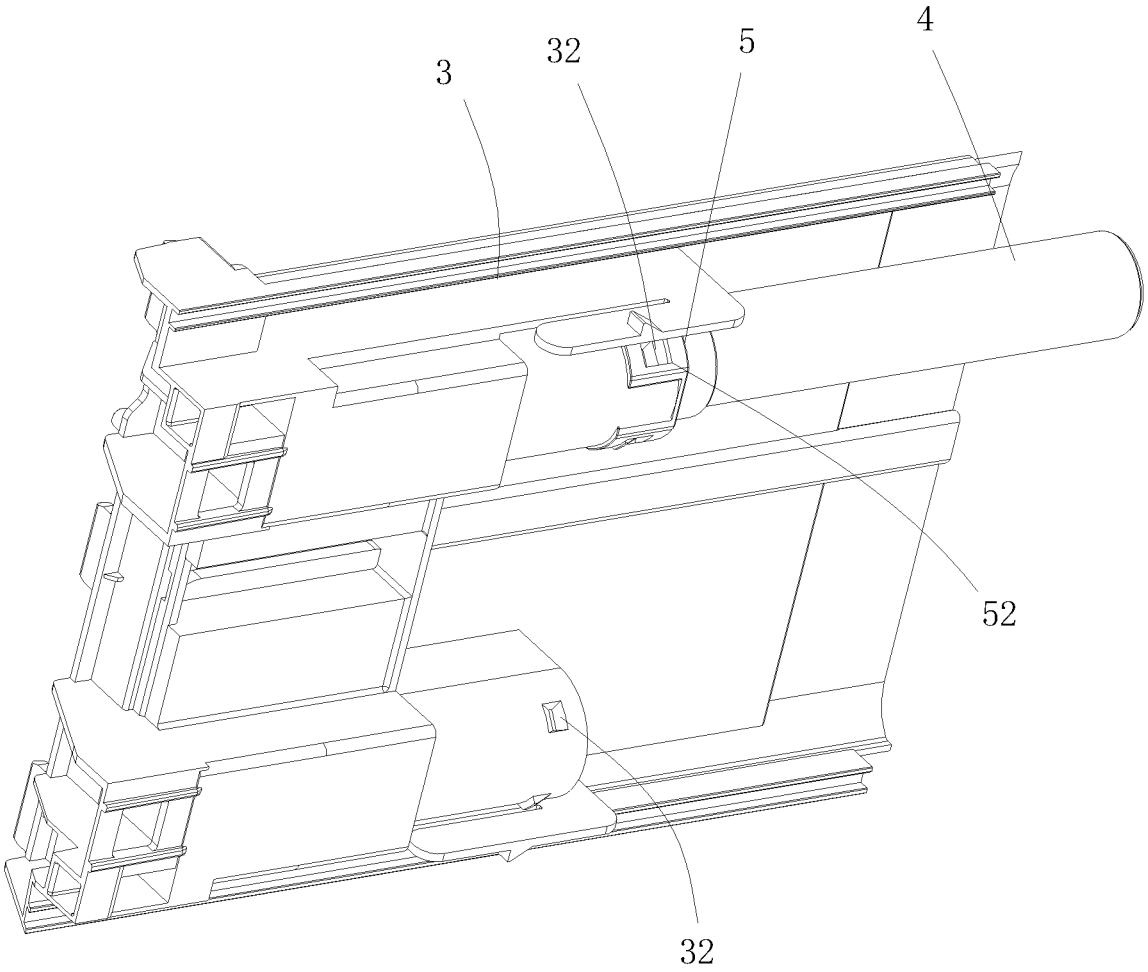
FIG. 26 is a schematic view showing the connection of a dispensing container, a liquid guiding tube and an anti-disengaging member of the clothing treatment agent dispensing assembly according to the fourth technical solution of the present disclosure.
Figure 27:
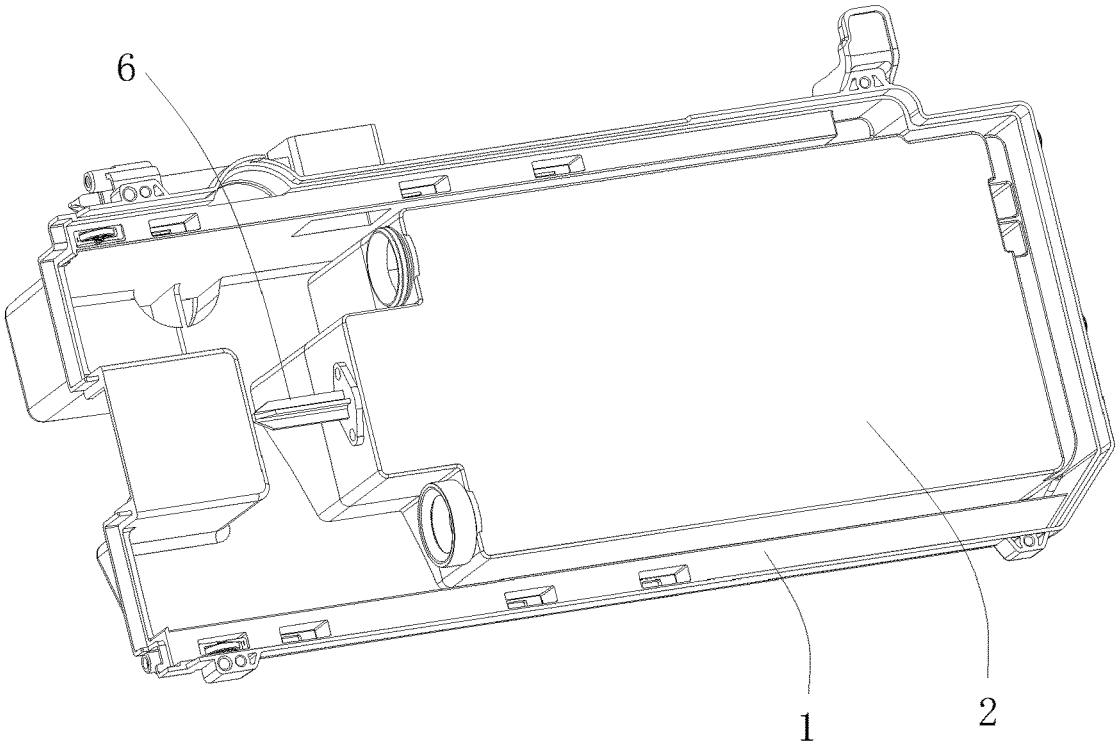
FIG. 27 is a schematic structural view of a storage container of the clothing treatment agent dispensing assembly according to the fourth technical solution of the present disclosure.

Specifically, as shown in FIGS. 25 to 27, the washing machine of the present disclosure includes a body, and the clothing treatment agent dispensing assembly includes a storage container 2, a dispensing container 3, a liquid guiding tube 4 and an anti-disengaging member 5. The storage container 2 is fixed in the body, and the dispensing container 3 is slidably connected to the body. One end of the liquid guiding tube 4 is in communication with the dispensing container 3, and the other end of the liquid guiding tube 4 is inserted into the storage container 2. A length of the liquid guiding tube 4 is set such that the other end of the liquid guiding tube 4 will not come out of the storage container 2 when the dispensing container 3 moves away from the storage container 2. The anti-disengaging member 5 is arranged to be capable of preventing the liquid guiding tube 4 and the dispensing container 3 from being separated from each other. In the present disclosure, the clothing treatment agent dispensing assembly is configured as a split structure, that is, the storage container 2 and the dispensing container 3 are separately provided, and only the dispensing container 3 is slidably connected with the body, so that when the user is adding the clothing treatment agent, he/she only needs to pull out the dispensing container 3 without also pulling out the storage container 2. The dispensing container 3 communicates with the storage container 2 through the liquid guiding tube 4, and a right end of the liquid guiding tube 4 is inserted into the storage container 2. When the dispensing container 3 is being pulled (the dispensing container 3 is moving to the left when viewed in the figure), the liquid guiding tube 4 is pulled out together with the dispensing container 3, but the right end of the liquid guiding tube 4 will not come out of the storage container 2, so that the clothing treatment agent injected into the dispensing container 3 can be delivered into the storage container 2 through the liquid guiding tube 4. After adding the clothing treatment agent, the user pushes the dispensing container 3 and the liquid guiding tube 4 together into the body. A right-side part of the liquid guiding tube 4 is inserted into the storage container 2.

In addition, through the anti-disengaging member 5, the clothing treatment agent dispensing assembly of the present disclosure can also prevent the liquid guiding tube 4 and the dispensing container 3 from being separated from each other, thereby preventing the liquid guiding tube 4 from completely entering the storage container 2. In a possible situation, the anti-disengaging member 5 is provided as a fixing frame, one end of which is fixedly connected to the dispensing container 3, and the other end of which is fixedly connected to the outer wall of the liquid guiding tube 4; that is, the liquid guiding tube 4 is fixedly connected with the dispensing container 3 by the fixing frame to prevent the liquid guiding tube 4 and the dispensing container 3 from being separated from each other; in another possible situation, the anti-disengaging member 5 is provided as a fixing seat, a left end of the fixing seat is snap-fit and fixed with the dispensing container 3, and a right end of the fixing seat is provided with an anti-disengaging tube (a length of the anti-disengaging tube is smaller than a length of the liquid guiding tube 4). An inner diameter of the anti-disengaging tube is slightly larger than an outer diameter of the liquid guiding tube 4, and a limiting ring is provided on the outer wall of the liquid guiding tube 4 near the left end (an outer diameter of the limiting ring is larger than the inner diameter of the anti-disengaging tube). A right end of the liquid guiding tube 4 is inserted into the anti-disengaging tube from the left end of the fixing seat and extends out of the anti-disengaging tube until the limiting ring abuts against the end of the anti-disengaging tube. After the left end of the liquid guiding tube 4 communicates with the dispensing container 3, the left end of the fixing seat is snap-fit and fixed with the dispensing container 3. The limiting ring abuts against the end of the anti-disengaging tube to prevent the liquid guiding tube 4 from moving to the right any longer relative to the dispensing container 3, thereby preventing the liquid guiding tube 4 and the dispensing container 3 from being separated from each other. Of course, the above two situations are only exemplary; for example, one end of the anti-disengaging member 5 may also be slidably connected to the dispensing container 3 (but it can only slide within a certain range), and the other end of the anti-disengaging member 5 may be fixedly connected to the liquid guiding tube 4, etc. Those skilled in the art can flexibly set the specific structure of the anti-disengaging member 5 in practical applications, and the specific connection form of the anti-disengaging member 5 with the dispensing container 3 and the liquid guiding tube 4, as long as the anti-disengaging member 5 can prevent the liquid guiding tube 4 and the dispensing container 3 from being separated from each other.

Preferably, as shown in FIG. 26, one end of the anti-disengaging member 5 is fixedly connected to the dispensing container 3, and a connection structure between the other end of the anti-disengaging member 5 and the liquid guiding tube 4 is arranged such that when the dispensing container 3 moves away from the storage container 2, the dispensing container 3 drives the liquid guiding tube 4 to move with the aid of the anti-disengaging member 5, and that when the dispensing container 3 moves close to the storage container 2, the anti-disengaging member 5 slides along the outer wall of the liquid guiding tube 4. That is, one end of the anti-disengaging member 5 is fixedly connected to the dispensing container 3, and the other end of the anti-disengaging member 5 is connected to the outer wall of the liquid guiding tube 4 in a one-way sliding manner A purpose of such an arrangement is to exert a pulling force on the outer wall of the liquid guiding tube 4 through the anti-disengaging member 5 when the dispensing container 3 moves, so as to drive the liquid guiding tube 4 to move, which can avoid affecting the sealing performance at a connection position of the dispensing container 3 and the liquid guiding tube 4. Specifically, a left end of the liquid guiding tube 4 is fixedly connected with the dispensing container 3. When the dispensing container 3 is being pulled, the dispensing container 3 and the liquid guiding tube 4 will tend to separate from each other at the connection position if there is no anti-disengaging member 5 to transmit the pulling force. After a period of use, the sealing performance at the connection position of the dispensing container 3 and the liquid guiding tube 4 may be reduced; and if the washing machine has not been used for a long time, the clothing treatment agent in the storage container 2 may make the liquid guiding tube 4 stuck to the inner wall of the storage container 2. In this case, a larger pulling force is required to pull the liquid guiding tube 4 out. If there is no anti-disengaging member 5 to transmit the pulling force, the dispensing container 3 and the liquid guiding tube 4 will have a larger tendency to separate from each other at the connection position, which may damage the sealing performance at the connection position. Therefore, applying the pulling force to the outer wall of the liquid guiding tube 4 by the anti-disengaging member 5 can avoid affecting the sealing performance at the connection position of the dispensing container 3 and the liquid guiding tube 4.

Still taking the fixing seat described in the previous paragraphs as an example, a left end of the fixing seat is snap-fit and fixed with the dispensing container 3, and a right end of the fixing seat is slidably connected to the outer wall of the liquid guiding tube 4. When the dispensing container 3 is being pulled, that is, when the dispensing container 3 moves away from the storage container 2, it can drive the fixing seat to move. The fixing seat transmits the pulling force to the limiting ring provided on the outer wall of the liquid guiding tube 4 through the anti-disengaging tube, so as to drive the liquid guiding tube 4 to move; and when the dispensing container 3 is being pushed, that is, when the dispensing container 3 moves close to the storage container 2, the fixing seat can slide along the outer wall of the liquid guiding tube 4. In another possible situation, the anti-disengaging member 5 may include a plurality of fixing rods. The fixing rod includes a horizontal rod and a vertical rod. The horizontal rod and the vertical rod are connected perpendicular to each other, that is, arranged in an L shape. There are three fixing rods, which are arranged on the outer wall of the liquid guiding tube 4 in a surrounding manner. The outer wall of the liquid guiding tube 4 is provided with three sliding grooves corresponding to the fixing rods, and ends of the horizontal rods can slide in the sliding grooves in the direction of the liquid guiding tube 4. In an assembled state, the ends of the horizontal rods abut against ends of the sliding grooves (a side close to the dispensing container 3), and ends of the vertical rods are fixed on the dispensing container 3 by fasteners. When the dispensing container 3 is being pulled, that is, when the dispensing container 3 moves away from the storage container 2, the fixing rods can be driven to move, and the fixing rods transmit the pulling force to the sliding grooves provided on the outer wall of the liquid guiding tube 4, so as to drive the liquid guiding tube 4 to move; and when the dispensing container 3 is being pushed, that is, when the dispensing container 3 moves close to the storage container 2, the horizontal rods of the fixing rods can slide in the sliding grooves provided on the outer wall of the liquid guiding tube 4. Of course, the above two situations are only exemplary, and should not be considered as limitations to the present disclosure.

In addition, it should be noted that as shown in FIG. 25, in order to enable the storage container 2 to be fixed in the body, a receiving box 1 for receiving the storage container 2 and the dispensing container 3 may be provided on the body, and the storage container 2 is fixed at a rear part of the receiving box 1 (a right part of the receiving box 1 when viewed in the figure). When the dispensing container 3 moves to a retracted position, the dispensing container 3 is received at a front part of the receiving box 1 (a left part of the receiving box 1 when viewed in the figure). In addition, the clothing treatment agent includes a detergent and a softener, etc. Such adjustments and changes to the specific kind and specific type of the clothing treatment agent do not depart from the principle and scope of the present disclosure, and should be defined within the scope of protection of the present disclosure.

In addition, it should also be noted that as shown in FIG. 25 and FIG. 27, two dispensing cavities 31 are provided on the dispensing container 3, one of which is a detergent dispensing cavity, and the other of which is a softener dispensing cavity. Correspondingly, the storage container 2 is provided with two storage cavities: a detergent storage cavity and a softener storage cavity. The detergent dispensing cavity communicates with the detergent storage cavity through one liquid guiding tube 4, and the softener dispensing cavity communicates with the softener storage cavity through another liquid guiding tube 4. Of course, the number of the dispensing cavities 31 is not limited to the above number of two. For example, the number of the dispensing cavities 31 may also be one or three, etc. Such adjustments and changes to the specific number of the dispensing cavities 31 do not depart from the principle and scope of the present disclosure, and should be defined within the scope of protection of the present disclosure.

Figure 28:
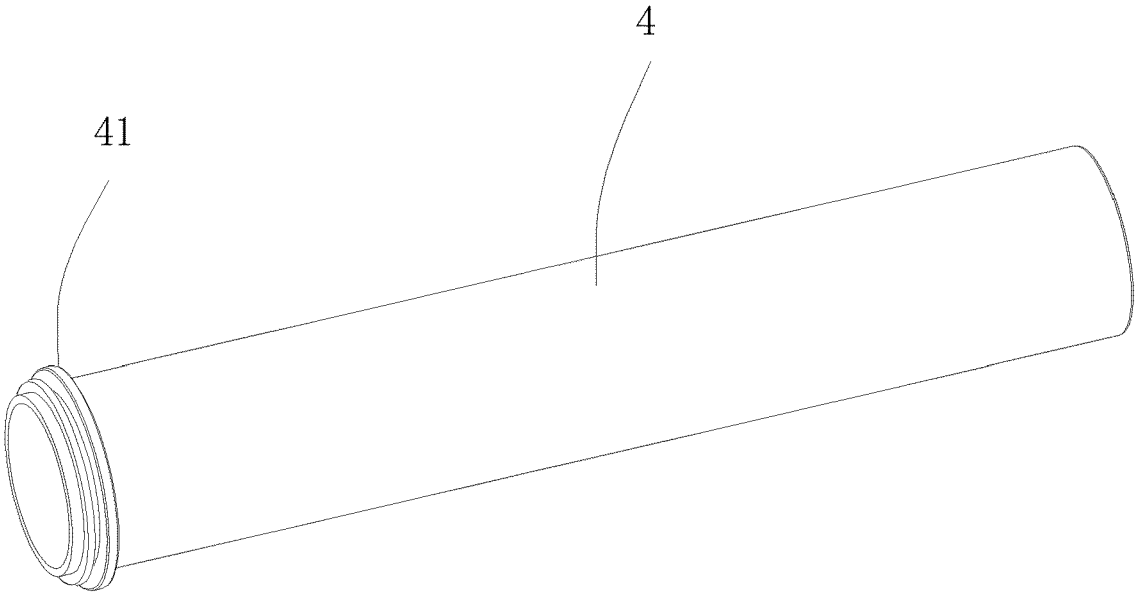
FIG. 28 is a schematic structural view of the liquid guiding tube of the clothing treatment agent dispensing assembly according to the fourth technical solution of the present disclosure.
Figure 29:
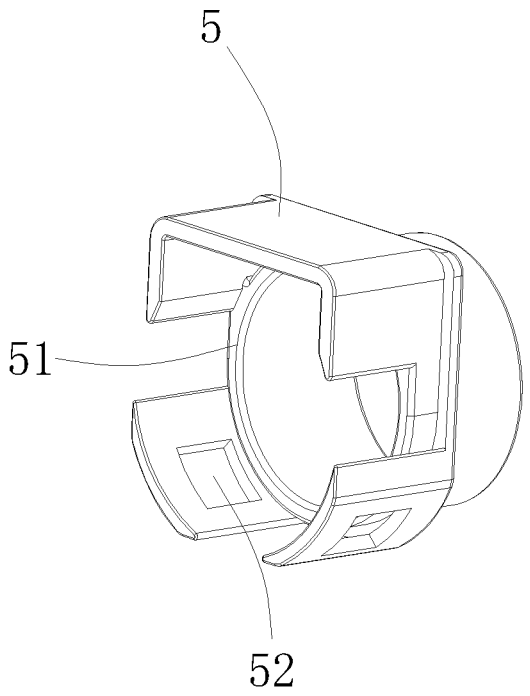
FIG. 29 is a schematic structural view of the anti-disengaging member of the clothing treatment agent dispensing assembly according to the fourth technical solution of the present disclosure.
Figure 30:
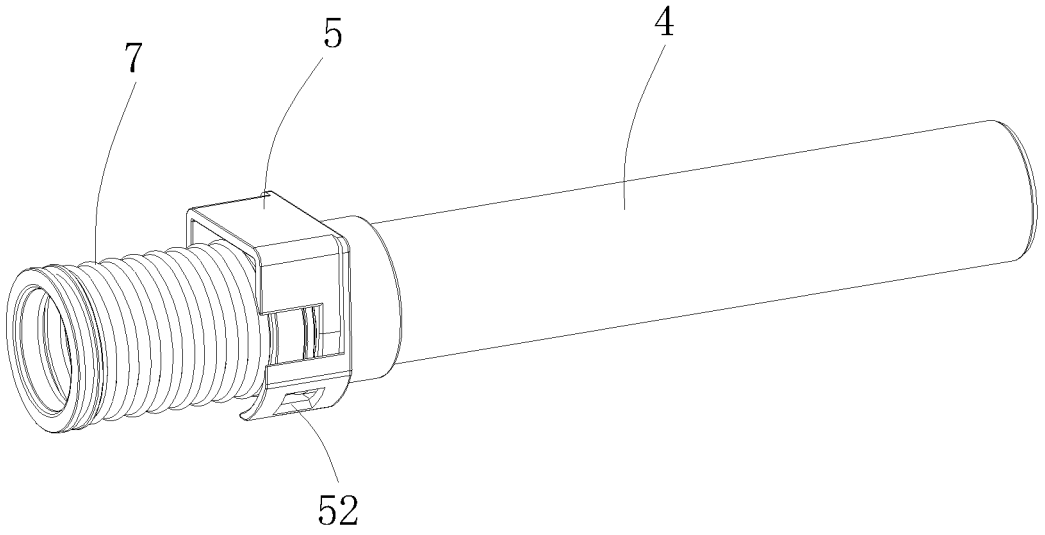
FIG. 30 is a schematic view showing the connection of a telescopic tube, the anti-disengaging member and the liquid guiding tube of the clothing treatment agent dispensing assembly according to the fourth technical solution of the present disclosure.

Preferably, as shown in FIGS. 28 to 30, the connection structure includes a limiting structure 41 provided on the outer wall of the liquid guiding tube 4 and an anti-disengaging structure 51 provided on the other end of the anti-disengaging member 5. When the dispensing container 3 moves away from the storage container 2 together with the anti-disengaging member 5, the liquid guiding tube 4 can be driven to move through a cooperation of the limiting structure 41 and the anti-disengaging structure 51. The limiting structure 41 is a ring-shaped limiting rib formed on the outer wall of the liquid guiding tube 4, and the anti-disengaging structure 51 is a ring-shaped boss. In an assembled state, when the dispensing container moves away from the storage container together with the anti-disengaging member, the ring-shaped limiting rib abuts against the ring-shaped boss. When the dispensing container 3 moves away from the storage container 2 together with the anti-disengaging member 5 (moving to the left as viewed in the figure), the ring-shaped boss abuts against the ring-shaped limiting rib, so that the liquid guiding tube 4 can be driven to move. Of course, the limiting structure 41 may also be provided as a ring-shaped boss, and correspondingly, the anti-disengaging structure 51 may be provided as a ring-shaped limiting rib; or the limiting structure 41 may also be provided as a limiting plate, and the anti-disengaging structure 51 may be provided as an anti-disengaging plate that is adapted to the limiting plate; or the limiting structure 41 is provided as a limiting block, and the anti-disengaging structure 51 is provided as an anti-disengaging bracket adapted to the limiting block, etc. Such adjustments and changes to the specific structural forms of the limiting structure 41 and the anti-disengaging structure 51 do not depart from the principle and scope of the present disclosure, and should be defined within the scope of protection of the present disclosure.

Preferably, as shown in FIGS. 26, 29 and 30, the dispensing container 3 is provided with a first snap-fit structure 32, one end of the anti-disengaging member 5 is provided with a second snap-fit structure 52, and the dispensing container 3 is snap-fit and fixedly connected to one end of the anti-disengaging member 5 through the first snap-fit structure 32 and the second snap-fit structure 52. The first snap-fit structure 32 is a snap-fit protrusion formed on the dispensing container 3, the second snap-fit structure 52 is a snap-fit opening provided on the anti-disengaging member 5, and the snap-fit protrusion matches with the snap-fit opening. Of course, the first snap-fit structure 32 may also be provided as a snap-fit opening, and correspondingly, the second snap-fit structure 52 is provided as a snap-fit protrusion. Such flexible adjustments and changes do not depart from the principle and scope of the present disclosure, and should be defined within the scope of protection of the present disclosure. In addition, the dispensing container 3 and the anti-disengaging member 5 may also be fixed by inserting or riveting, etc. Such adjustments and changes to the specific fixing form of the dispensing container 3 and the anti-disengaging member 5 do not depart from the principle and scope of the present disclosure, and should be defined within the scope of protection of the present disclosure.

Preferably, as shown in FIG. 27, the clothing treatment agent dispensing assembly further includes a push switch 6, which is arranged to be capable of locking the dispensing container 3 on the body and/or the storage container 2 after the dispensing container 3 is pushed into the body. The push switch 6 includes a moving member, a locking member (not shown in the figure) and a spring (also not shown in the figure). In a possible situation, as shown in FIG. 27, the push switch 6 is arranged between the dispensing container 3 and the storage container 2. One end of the moving member is fixedly connected with the dispensing container 3, and the other end of the moving member is connected with the locking member and the spring that are provided in the storage container 2. After the dispensing container 3 is pushed into the body, the other end of the moving member is locked by the locking member to lock the dispensing container 3 tightly on the storage container 2. When the user needs to add the clothing treatment agent, he/she only needs to gently push the dispensing container 3 in a direction toward the storage container 2. After the push switch 6 is applied a force, the other end of the moving member and the locking member are unlocked, and the dispensing container 3 is pushed out under the action of the spring; of course, the above situation is only exemplary, and the push switch 6 may also be arranged between the dispensing container 3 and the body, or between the dispensing container 3 and the storage container 2 and also between the dispensing container 3 and the body. Such adjustments and changes to the specific arrangement position of the push switch 6 do not depart from the principle and scope of the present disclosure, and should be defined within the scope of protection of the present disclosure. In addition, it should be noted that the specific structure of the push switch 6 is not limited to the above specific structure. Those skilled in the art may flexibly set the specific structure of the push switch 6 in practical applications, and any push switch that can realize locking by being pressed once and realize unlocking by being pressed once more will fall within the scope of protection of the present disclosure.

Preferably, as shown in FIG. 30, the clothing treatment agent dispensing assembly further includes a telescopic tube 7, one end of the liquid guiding tube 4 is in communication with the dispensing container 3 through the telescopic tube 7, and the telescopic tube 7 can be extended and retracted to allow the dispensing container 3 to move toward the storage container 2 when the liquid guiding tube 4 is stuck or does not move smoothly enough, so as to unlock the push switch 6 and thus enable the push switch 6 to push the dispensing container 3 out. That is, a left end of the liquid guiding tube 4 is fixedly connected to a right end of the telescopic tube 7, and a left end of the telescopic tube 7 is fixedly connected to the dispensing container 3. If the liquid guiding tube 4 cannot move or does not move smoothly enough, when the dispensing container 3 is pushed, the telescopic tube 7 can be compressed so that the dispensing container 3 can move toward the storage container 2, thus unlocking the push switch 6 by force. The telescopic tube 7 is a bellows. Of course, the telescopic tube 7 may also be provided as a telescopic sleeve or a rubber tube. Such flexible adjustments and changes do not depart from the principle and scope of the present disclosure, and should be defined within the scope of protection of the present disclosure. It should be noted that one end of the anti-disengaging member 5 is fixedly connected to the dispensing container 3, and the other end of the anti-disengaging member 5 is connected to the outer wall of the liquid guiding tube 4 in a one-way sliding manner. Another purpose of such an arrangement is that when the liquid guiding tube 4 cannot move or does not move smoothly enough, by pushing the dispensing container 3, the anti-disengaging member 5 can slide along the outer wall of the liquid guiding tube 4, so that the dispensing container 3 can move toward the storage container 2, and the push switch 6 is unlocked by force.

In addition, it should be noted that although only one embodiment is provided for die push switch 6 and only three embodiments are provided for the telescopic tube 7, it should be understood by those skilled in the art that the contribution of the present disclosure over the prior art is reflected in a combined use of the push switch 6 and the telescopic tube 7, and the scope of protection of the present disclosure should not be limited to the specific structures of the telescopic tube 7 and the push switch 6. Therefore, the use of other structures of the push switch 6 or other types of the telescopic tube 7 will also fall within the scope of protection of the present disclosure.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing treatment agent dispensing assembly for a clothing treatment device, the clothing treatment device comprising a body, wherein the clothing treatment agent dispensing assembly comprises:

a storage container, a dispensing container, and a liquid guiding tube;

wherein the storage container is fixed in the body, and the dispensing container is slidably connected to the body;

wherein one end of the liquid guiding tube is in communication with the dispensing container, and the other end of the liquid guiding tube is inserted into the storage container; and wherein a length of the liquid guiding tube is set such that the other end of the liquid guiding tube will not come out of the storage container when the dispensing container moves away from the storage container; and wherein the clothing treatment agent dispensing assembly further comprises a push switch, and the push switch is arranged to be capable of locking the dispensing container on the body and/or the storage container after the dispensing container is pushed into the body.

2. The clothing treatment agent dispensing assembly according to claim 1, wherein a guiding structure is provided on the storage container, and the other end of the liquid guiding tube passes through the guiding structure and is inserted into the storage container.

3. The clothing treatment agent dispensing assembly according to claim 2, wherein the guiding structure is a guide tube joint formed on an outer wall of the storage container.

4. The clothing treatment agent dispensing assembly according to claim 1, wherein the clothing treatment agent dispensing assembly further comprises a telescopic tube, one end of the liquid guiding tube is in communication with the dispensing container through the telescopic tube, and the telescopic tube can be extended and retracted to allow the dispensing container to move toward the storage container when the liquid guiding tube is stuck or does not move smoothly enough, so as to unlock the push switch and thus enable the push switch to push the dispensing container out.

5. The clothing treatment agent dispensing assembly according to claim 4, wherein a support structure is provided on the dispensing container, and in an assembled state, the telescopic tube is located above the support structure.

6. The clothing treatment agent dispensing assembly according to claim 5, wherein the support structure is a U-shaped plate, and in an assembled state, the telescopic tube is located in a receiving cavity formed by the U-shaped plate.

7. The clothing treatment agent dispensing assembly according to claim 4, wherein the telescopic tube is a bellows or a telescopic sleeve.

8. The clothing treatment agent dispensing assembly according to claim 4, wherein the clothing treatment agent dispensing assembly further comprises an anti-disengaging member, one end of the anti-disengaging member is fixedly connected to the dispensing container, and a connection structure between the other end of the anti-disengaging member and the liquid guiding tube is arranged such that when the dispensing container moves away from the storage container, the dispensing container drives the liquid guiding tube to move with the aid of the anti-disengaging member, and that when the dispensing container moves close to the storage container, the anti-disengaging member slides along an outer wall of the liquid guiding tube.

9. The clothing treatment agent dispensing assembly according to claim 8, wherein the connection structure comprises a limiting structure provided on the outer wall of the liquid guiding tube and an anti-disengaging structure provided on the other end of the anti-disengaging member; when the dispensing container moves away from the storage container together with the anti-disengaging member, the liquid guiding tube can be driven to move through the cooperation of the limiting structure and the anti-disengaging structure.

10. The clothing treatment agent dispensing assembly according to claim 9, wherein the limiting structure is a ring-shaped limiting rib or a ring-shaped boss formed on the outer wall of the liquid guiding tube, and correspondingly the anti-disengaging structure is a ring-shaped boss or a ring-shaped limiting rib; and in an assembled state, when the dispensing container moves away from the storage container together with the anti-disengaging member, the ring-shaped limiting rib abuts against the ring-shaped boss.

11. The clothing treatment agent dispensing assembly according to claim 8, wherein the dispensing container is provided with a first snap-fit structure, the anti-disengaging member is provided with a second snap-fit structure, and the dispensing container is fixedly connected to one end of the anti-disengaging member through the first snap-fit structure and the second snap-fit structure.

12. The clothing treatment agent dispensing assembly according to claim 11, wherein one of the first snap-fit structure and the second snap-fit structure is a snap-fit protrusion, the other of the first snap-fit structure and the second snap-fit structure is a snap-fit opening, and the snap-fit protrusion matches with the snap-fit opening.

13. The clothing treatment agent dispensing assembly according to claim 1, wherein a sliding part is provided on the dispensing container, a roller that cooperates with the sliding part is provided on the body, and the dispensing container is slidably connected with the body through the sliding part and the roller.

14. A clothing treatment device, comprising the clothing treatment agent dispensing assembly according to claim 1.

* * * * *